US010179269B2

(12) United States Patent
Chu

(10) Patent No.: US 10,179,269 B2
(45) Date of Patent: Jan. 15, 2019

(54) ARMED COMBAT INTERACTIVE SYSTEM BASED ON HIGH FREQUENCY WIRELESS SCORING

(71) Applicant: Kapan Chu, Wanchai (HK)

(72) Inventor: Kapan Chu, Wanchai (HK)

( * ) Notice: Subject to any disclaimer, the term of this patent is extended or adjusted under 35 U.S.C. 154(b) by 0 days.

(21) Appl. No.: 15/311,035

(22) PCT Filed: Apr. 29, 2015

(86) PCT No.: PCT/CN2015/077757
§ 371 (c)(1),
(2) Date: Nov. 14, 2016

(87) PCT Pub. No.: WO2015/172656
PCT Pub. Date: Nov. 19, 2015

(65) Prior Publication Data

US 2017/0080314 A1 Mar. 23, 2017

(30) Foreign Application Priority Data

May 13, 2014 (CN) ..... 2014 1 0200242
Apr. 1, 2015 (CN) ..... 2015 2 0191517 U
(Continued)

(51) Int. Cl.
*A63F 9/00* (2006.01)
*A63B 69/00* (2006.01)
(Continued)

(52) U.S. Cl.
CPC ..... *A63B 69/00* (2013.01); *A63B 69/02* (2013.01); *A63B 69/04* (2013.01); *A63B 71/06* (2013.01);
(Continued)

(58) Field of Classification Search
None
See application file for complete search history.

(56) References Cited

U.S. PATENT DOCUMENTS 7,891,231 B2 2/2011 Song
2001/0023218 A1* 9/2001 Marciano ..... A63B 71/10 482/12
(Continued)

FOREIGN PATENT DOCUMENTS

CN 201316517 Y 9/2009
CN 101648067 A 2/2010
CN 203017725 U 6/2013

OTHER PUBLICATIONS

English translation of CN 101648067 B.*

*Primary Examiner* — Seng H Lim
(74) *Attorney, Agent, or Firm* — Rabin & Berdo, P.C.

(57) ABSTRACT

An armed combat interactive system based on high frequency wireless scoring, comprising a moving device, a combat device, a protecting device, a wireless identification control device and a scoring disposing device. When a first conductive part of one combat device touches a second conductive part of the protecting device corresponding to the other combat device, the wireless identification control device corresponding to one combat device sends a high frequency impulse signal with an ID identification code, and the wireless identification control device corresponding to the other combat device receives the high frequency impulse signal with the ID identification code and sends a scoring signal to the scoring disposing device. The scoring disposing device records the score.

28 Claims, 13 Drawing Sheets

(30) Foreign Application Priority Data

Apr. 1, 2015 (CN) ..... 2015 2 0192421 U
Apr. 1, 2015 (CN) ..... 2015 2 0192895 U

(51) Int. Cl.
*A63B 71/06* (2006.01)
*A63B 69/02* (2006.01)
*A63B 69/04* (2006.01)
*A63B 71/12* (2006.01)

(52) U.S. Cl.
CPC ..... *A63B 71/0622* (2013.01); *A63B 71/12* (2013.01); *A63B 2220/833* (2013.01); *A63B 2220/836* (2013.01); *A63B 2225/50* (2013.01)

(56) References Cited

U.S. PATENT DOCUMENTS

2006/0100022 A1* 5/2006 Linsay ..... A63B 69/02 463/47.1
2012/0010002 A1* 1/2012 Hart ..... A63B 69/02 463/47.1
2012/0028721 A1* 2/2012 Johnson ..... A63B 69/02 463/47.1
2015/0148114 A1* 5/2015 Morehouse ..... A63B 71/0605 463/8
2015/0148139 A1* 5/2015 Morehouse ..... A63B 69/02 463/47.1

* cited by examiner

ARMED COMBAT INTERACTIVE SYSTEM BASED ON HIGH FREQUENCY WIRELESS SCORING

TECHNICAL FIELD

The present invention relates to an interactive system combining fitness exercise or entertainment activity with combat sports, particularly to an armed interactive combat system based on high frequency wireless scoring.

BACKGROUND

With the economic development and living standard improvement, one cares increasingly more about the health care. There are more and more fitness sports facilities, and people increasingly attend various fitness sports, such as ball games, swimming and jogging. Some entertainment sports are popular, such as fencing and equestrian sports. These fitness sports usually need scoring devices to display the scores. For example, in a fencing competition, one needs to collect the signals indicating the hits succeeded by the opponent. Existing scoring devices, for example, those disclosed in Chinese publications CN101791470A, CN103182177A, CN102671364A, can usually only record the scores of two persons in combat, have complex structures and high costs, are only available in competition scoring, and cannot identify the stabbed positions, nor automatically accumulate the scores of the stabbed positions. Widespread applications of armed combat interactive systems are therefore limited.

SUMMARY

To solve the technical problems of the existing known technology, the present invention is provided with an armed combat interactive system based on high frequency wireless scoring, which can automatically differentiate the identity of the armor and the different positions touched by the armour and respectively accumulate the scores of the touched different positions, it can realize scoring of a multi-player interactive combat. During the combat, the fighters ride the moving devices to chase and crash in the field, it scores the effective scores during the crash. The sports improves the entertainment, the fighter can achieve exercise and fitness.

The technical solution of the present invention is:

An armed combat interactive system based on high frequency wireless scoring, comprising:

a moving device capable to carry a combat participant to move on a preset sports field;

a combat device for the combat participant riding on the moving device to hold, the combat device having a first conductive portion for realizing an electrical contact and a first port for realizing an electric connection, the first conductive portion connected to the first port;

a protecting device to protect a given external portion of the combat participant riding on the moving device, the protecting device has at least one second conduction portion for realizing an electrical contact and a second port for realizing an electric connection, the second conductive portion connected to the second port;

a scoring processing device, the scoring processing device comprising a second high frequency wireless transmission module;

a wireless identification control device, the wireless identification control device configured on a body of the combat participant riding on the moving device, the wireless identification control device comprising a third port and a fourth port for realizing an electric connection and a first high frequency wireless transmission module for realizing a wireless signal transmission. The third port of the wireless identification control device connected to the first port of the combat device, so that the wireless identification control device is connected to the first conductive portion of the combat device, the fourth port of the wireless identification control device connected to the second port of the protecting device, so that the wireless identification control device is connected to the second conductive portion of the protecting device, the first high frequency wireless transmission module and the second high frequency wireless transmission module connected through wireless communication;

when the first conductive portion of the combat device held by a first combat participant touches the second conductive portion of the protecting device of a second combat participant, the wireless identification control device of the first combat participant sends a high frequency pulse signal with an ID identification code via the first conduction portion. The wireless identification control device of the second combat participant receives the high frequency pulse signal with the ID identification code of the wireless identification control device of the first combat participant via the second conductive portion, the wireless identification control device of the second combat participant sends a scoring signal to the scoring processing device via the first high frequency wireless transmission module after corresponding processing, and the scoring processing device processes corresponding scoring.

As a preferred solution, the wireless identification control device further comprises a first MCU control module, a high frequency pulse contact transmission module, an alarm module and at least two high frequency pulse contact receiving modules. The first high frequency wireless transmission module is connected to the first MCU control module, a high frequency pulse signal output port of the first MCU control module is connected to an input of the high frequency pulse contact transmission module, the high frequency pulse signal input port of the first MCU control module is connected to the outputs of the at least two high frequency pulse contact receiving module respectively, a control signal output port of the first MCU control module is connected to the alarm module, an output of the high frequency pulse contact transmission module is connected to the third port, inputs of the at least two high frequency pulse contact receiving modules are connected to the respective fourth ports.

As a preferred solution, the scoring processing device comprises a USB wireless host provided in a periphery area of the sports field, a host computer provided in the periphery area of the sports field and an LED display screen provided in the periphery area of the sport field. The second high frequency wireless transmission module is provided in the USB wireless host; and the USB wireless host further comprises a second MCU control module and a USB data transmission module, the second high frequency wireless transmission module is connected to the second MCU control module, and the second MCU control module is connected to the USB data transmission module; wireless transmission of data between the USB wireless host and the wireless identification control device is implemented through the first high frequency wireless transmission module and the second high frequency wireless transmission module. The host computer has an ID encode module, a signal processing module, a scoring module and a display module; wired transmission of data between the host computer and the USB wireless host is implemented through the USB data transmission module; an input of the LED display screen is connected to an output of the host computer.

As a preferred solution, the alarm module comprises an LED indication module and a music control module, the LED indication module and the music control module are connected to the control signal output port of the first MCU control module respectively. As a preferred solution, the USB wireless host further comprises an external wireless remote transmission module and a wireless remote receiving module, and an output of the wireless remote receiving module is connected to the second MCU control module.

As a preferred solution, the ID encode module of the host computer assigns different ID identification codes respectively to a plurality of wireless identification control devices via the USB wireless host. When the first conduction portion of a first wireless identification control device touches the second conduction portion of a second wireless identification control device, the first MCU control module of the first wireless identification control device sends a high frequency pulse signal with the ID identification code of the wireless identification control device via the high frequency pulse touch transmission module of the first wireless identification control device. The high frequency pulse touch receiving module of the second wireless identification control device receives the high frequency pulse signal of the corresponding ID identification code and transforms the high frequency pulse signal of the corresponding ID identification code to the corresponding ID identification code, and the corresponding ID identification code is output to the first MCU control module of the second wireless identification control device. The first MCU control module of the second wireless identification control device packs the corresponding ID identification code, the ID identification code of the second wireless identification control device and a characterization code distinguishing the position of the second conductive portion connected to the second wireless identification control device into a data packet, and the data packet is sent to the USB wireless host using the transmission protocol between the second wireless identification control device and the USB wireless host. The USB wireless host sends the data packet to the host computer via the USB data transmission module, the signal processing module of the host computer identifies, determines and analyzes information in the data packet. When the corresponding ID identification code is identical to a preset ID identification code, it is judged as an invalid signal. When the corresponding ID identification code is different from the present ID identification code, the signal processing module of the host computer outputs control signal to the second wireless identification control device via the USB wireless host, the first MCU control module of the second wireless identification control device outputs a signal to the alarm module of the second wireless identification control device after receiving the control signal, and the alarm module alarms, the signal processing module of the host computer outputs signal concurrently to the scoring module of the host computer, the scoring module processes the score according to a preset mode and outputs a scoring result to a display module of the host computer, the display module of the host computer drives the LED display screen to display.

As a preferred solution, the combat device comprises a device body and a device handle. The device body comprises, from an interior to an exterior, a main skeleton body, a cushion layer and a surface layer. The cushion layer coats the main skeleton body, the surface layer coats the cushion layer. The device body connects the device handle. The surface layer is composed of conductive material or composite conductive material. The surface layer forms the first conductive portion.

As a preferred solution, the device body further comprises a stab-proof layer, the stab-proof layer coats the main skeleton body, the cushion layer coats the stab-proof layer. The main skeleton body is an elastic structure made of an elastic metal material, an elastic non-metal martial or a combination thereof. The cushion layer is an elastic body made of composite material, rubber or foamed plastic. The stab-proof layer is a coat made of stab-proof cloth or composite material.

As a preferred solution, the device handle comprises a skeleton core, a device body fixing component, a hand-grasp component, a device handle hand-guard component and a weight balance body, the device body fixing component is connected between the main skeleton of the device body and the skeleton core of the device handle, one end of the hand-grasp component is connected to the device body fixing component, the other end of the hand-grasp component is connected to the weight balance body. The device handle hand-guard component is arc-shaped and connected between the device body fixing component and the weight balance body.

As a preferred solution, the surface layer is made of conductive cloth. The conductive cloth is connected to the device handle via a lead wire. The skeleton core of the device handle is integrally connected to the main skeleton body of the device body.

As a preferred solution, the hand-grasp component is made of conductive material, the conductive cloth is connected to the hand-grasp component via a lead wire. The hand-grasp component forms the first port.

As a preferred solution, the hand-grasp component is made of insulate material, the device body fixing component is provided with a first signal transmission port, the conductive cloth is connected to the first signal transmission port via a lead wire. The first signal transmission port forms the first port.

As a preferred solution, the protecting device comprises an armor. The armor is formed of an inner protecting cloth layer and a outer conductive material layer, the outer conductive material layer covers the center portion and upper portion of the body wearing the armor, and the outer conductive material layer forms the second conductive portion. A connecting device for the combat device electric signal is further provided at the position of the armor corresponding to the end position of the arm of the person wearing the armor for receiving the electric signal of the hand-grasp combat device. The armor is further provided with a signal transmission joint, the signal transmission joint is provided with at least two signal transmission wires, one wire is connected to the electric signal joint of the combat device, the other wire is the second port, and connected to the conductive material of the armor.

The armor is further provided with an air inlet joint and an air duct, the air duct is connected to the air inlet joint, and the air duct is further provided with a first air spraying hole, a first ventilating hole throughout inside and outside is provided in the armor.

As a preferred solution, the protecting device further comprises a helmet. The helmet is made of glass steel with a surface coated with a conductive layer or metal material, the conductive layer coated on the surface or the metal material to form the second conductive portion. A signal transmission joint is further provided with a third signal transmission wire, the third signal transmission wire forms the second port and is connected to the conductive layer or the metal material of the helmet.

As a preferred solution, the helmet is provided with a metal protecting net at a position corresponding to the face of the person. The armor is provided with a first slot at a position corresponding to a front portion of a wearer, the first slot is provided with a first zipper closing the first gap when the first zipper is zipped.

As a preferred solution, the protecting device further comprises a air-blowing device, which is connected to the air inlet joint.

As a preferred solution, the protecting device further comprises a neck collar connected between the helmet and the armor, the neck collar comprises an upper part, a center part and a lower part. The upper part and the lower part are made of material composed of cloth material and hard elastic material body, and the cloth material is arranged at a surface layer. The center part is elastic cloth. The elastic cloth is connected between the upper cloth material layer and the lower cloth material layer. The lower part of the neck collar is further provided with a plurality of second ventilating holes surrounding a neck of the wearer.

As a preferred solution, the neck collar is provided with a disconnecting portion along the vertical direction to vertically disconnect neck collar. The disconnecting portion is disposed with a first nylon fastener or a first button, the neck collar forms a shape surrounding a neck of the wearer by the first nylon fastener or the first button. The neck collar and the helmet are connected and fixed by a second nylon fastener or a second button. The neck collar and the armor are connected by a second zipper or a third button.

As a preferred solution, the moving device comprises a bottom plate, a walking mechanism, a driving mechanism, a moving mechanism, a stand rack, a steering mechanism and an animal model. The waling mechanism is assembled to the bottom plate to drive the bottom plate to move. The driving mechanism is assembled to the bottom plate and is coupled to the walking mechanism. The stand rack is assembled to the bottom plate, and the moving mechanism is assembled to the stand rack and is coupled to the driving mechanism, the moving mechanism imitates an animal motion under the supporting of the stand rack and the driving of the driving mechanism. The animal model is assembled to a moving mechanism to simulate an animal movement. The steering mechanism is assembled to the front portion of the animal model and is coupled to the walking mechanism to control the steering of the walking mechanism.

As a preferred solution, the moving device further comprises a transmission, the transmission is assembled to the bottom plate, the driving mechanism is coupled to the walking mechanism and the moving mechanism respectively via the transmission. The transmission comprises a first transmission with single speed change and a second transmission with multiple speed change, the driving mechanism is coupled to the walking mechanism via the first transmission with single speed change, the driving mechanism is coupled to the second moving mechanism via the second transmission with multiple speed change.

As a preferred solution, the moving mechanism comprises a swinging crossing rack and a simulating motion mechanism. The simulating motion mechanism comprises two cranks, two driven rotating arms, a driving shaft and a driven shaft. The driving shaft and the driven shaft are respectively assembled to a front portion and a rear portion of the stand rack and are rotatable, and the driving shaft is coupled to the driving mechanism; each end of the two cranks are respectively connected to two ends of the driving shaft; each of the other ends of the two cranks are respectively connected to the front portion of the swinging crossing rack. The two driven rotating arms are respectively connected between the two ends of the driven shaft and the rear portion of the swinging cross arm.

As a preferred solution, the swinging crossing rack comprises a crossing rack body, a saddle shaped support and a step mounting rack. The front portion of the crossing rack body is provided with a crank bearing base to connect to the crank, the rear portion of the crossing rack body is provided with a driven bearing base to connect to the driven rotating arm. The saddle shaped support is fixed to the rear portion of the crossing rack body. The step mounting rack is fixed to the bottom portions at the two sides of the crossing rack body.

As a preferred solution, the animal model comprises a fixing rack and an animal model shell. The fixing rack comprises a body fixing rack and a head fixing rack, the body fixing rack is fixed to the crossing rack body, the head fixing rack is fixed to the upper portion of a front side of the body fixing rack. The steering mechanism is assembled to the head fixing rack.

As a preferred solution, the steering mechanism comprises a steering handle, a steering upper chain wheel, a steering lower chain wheel, an upper chain, a lower chain and a steel wire, the steering handle is assembled to the head fixing rack, the steering upper chain wheel is assembled on the steering handle, the steering lower chain wheel is assembled on the walking mechanism, the upper chain and the lower chain are assembled to the steering upper chain wheel and the steering lower chain wheel respectively, the two chains are connected by the steel wire.

As a preferred solution, the walking mechanism comprises a front wheel mechanism and a rear wheel mechanism, the front wheel mechanism comprises two front wheels and a front wheel rotating shaft, two front wheels are assembled to two ends of the front wheel rotating shaft respectively, the lower chain wheel is assembled to the upper end of the front wheel rotating shaft.

As a preferred solution, the rear wheel mechanism comprises a driving rear wheel, a driven rear wheel, a rear wheel rotating shaft, a support bearing base, a chain plate and a brake.

The driving rear wheel, the driven rear wheel, the support bearing base, the chain plate and the brake are assembled to the rear wheel rotating shaft respectively. The driving rear wheel is assembled to the rear wheel rotating shaft by a power lock, the driving rear wheel and the rear wheel rotating shaft rotate synchronously. The driven rear wheel is assembled to the rear wheel rotating shaft by a rolling bearing. The rear wheel mechanism is assembled to the bottom plate by the support bearing base connecting to the bottom plate.

As a preferred solution, the moving device further comprises an energy storing mechanism, the energy storing mechanism comprises a first spring mechanism and a second spring mechanism, the first spring mechanism is assembled between the swinging crossing rack and the bottom plate. The second spring mechanism is assembled between the stand rack and the driven rotating arm.

As a preferred solution, the moving mechanism further comprises a common-ground conductive wheel, the common-ground conductive wheel is assembled to the bottom portion of the bottom plate.

As a preferred solution, the moving device further comprises a temperature regulating device, the temperature regulating device comprises an air pump and an air duct, the air pump is assembled to the stand rack, the air duct extends from the air pump and is fixed to the swinging crossing rack.

The scoring process of the armed combat interactive system comprises:

when the second conduction portion of the protecting device of a second wireless identification control device is touched by the first conduction portion of the combat device of a first wireless identification control device, the high frequency pulse touch receiving module of the second wireless identification control device receives the high frequency pulse electrical signal with an ID identification code;

the high frequency pulse touch receiving module transmits the high frequency pulse electrical signal with an ID identification code to the first MCU control module of the second wireless identification control device;

the first MCU control module of the second wireless identification control device packs the received ID identification code, the ID identification code of the second wireless identification control device and a characterization code distinguishing the position of the conductive portion into a data packet through a first high frequency wireless transmission module;

a second high frequency wireless transmission module of the USB wireless host transmits the received data packet to the second MCU control module of the USB wireless host, the second MCU control module transmits the analyzed and processed data to the host computer through the USB data transmission module;

the host computer determines the validity of the data, if the data is invalid, return to step A; if the data is valid, continue to the next step;

the host computer accumulates the scores according to the preset scoring modes and the corresponding positions of the second conductive portion and displays the scoring results through the LED display screen, at the same time, the host computer transmits control command to the second MCU control module of the USB wireless host through the USB data transmission module;

the second MCU control module of the USB wireless host transmits the control command from the host computer to the first high frequency wireless transmission module of the second wireless identification control device through the second high frequency wireless transmission module in wireless way;

the first high frequency wireless transmission module of the second wireless identification control device transmits the control command to the first MCU control module, a corresponding control signal is generated after the first MCU control module analyzes and processes the control command, and the control signal is output to the alarm module; and the scoring process ends after the alarm module alarms with sound and light.

With above-mentioned technical solutions, the present invention has advantages compared with the existing known technology:

1. The armed combat interactive system based on high frequency wireless scoring is disposed with a moving device, a combat device, a protecting device, a wireless identification control device and a scoring device. When the first conductive part of the combat device held by a combat participant touches the second conductive part of the protecting device of the other combat participant, the wireless identification control device of the combat participant sends a high frequency pulse signal with ID identification code via the first conduction part. The wireless identification control device of the other combat participant receives the high frequency pulse signal with ID identification code of the wireless identification control device of the combat participant via the second conductive part. After corresponding process, the wireless identification control device of the other combat participant sends a scoring signal to the scoring disposing device via the first high frequency wireless transmission module, the scoring disposing device recodes the score.

The system can automatically identify the armed identity and the touched different portions and respectively accumulate the scores of the touched different portions. The armed combat participants can achieve exercise effect during entertainment to realize fitness, but also realize a multi-player scoring, thus increasing the entertainment value of the sports.

2. The whole outer surface of the combat device is disposed with a conductive cloth layer, results in the whole machine being conductive, for conveniently retrieving the electric signal, thus realizing effective scoring and improving the entertainment of the armed game. The device body is disposed with a main backbone, an anti-puncturing layer, a buttering layer and a conductive layer, resulting in the device body being light in weight and having effective anti-puncturing capability, which not only provides convenience to use in the game, but also lengthens the service life of the device body.

3. The main backbone of the combat device is made of elastic steel or glass fibre, having both the rigidity and elasticity. The anti-puncturing layer is made of anti-puncturing cloth, with reduced weight and size, and convenience to assemble. The buffer layer is made of sponge or rubber, which is light in weight, and protects the main backbone, when touched by the opponent, it provides a cushion function to avoid hurting the opponent.

4. The protecting device is disposed with a suit of armor, the surface of the armor is made of conductive material to transmit signals. The armor is assembled with air inlet joint and an air pipe. An air blowing device is connected to the air inlet joint to blow cool air, common temperature air, or hot air to the armor, and air flows out of the first air hole to provide air circulation in the interior, it also corporates with the sweat layer one wears for preventing heat, maintaining temperature and deodorization.

5. The armor is disposed with a first zipper at the front position when worn on a human body, for convenient self-wear. A second zipper is disposed between the neck collar and the armor to make the neck collar detachable for washing and cleaning. The surface of the upper and lower portion of the neck collar is made of cloth, the inner layer is applied with an elastic material having a certain hardness, the center portion is made of elastic cloth, so that the player feels comfortable. The outer side is connected by nylon fastener, the player can adjust the size of the neck collar according to his own circumstances. The second air holes of the neck collar have breath and heat proofing functions. The neck collar is connected to the armor by the second zipper 343 and is connected to the helmet by nylon fastener, it functions as the neck and the throat protection.

6. The moving device comprises a bottom plate, a walking mechanism, a driving mechanism, a stand, a steering mechanism and an animal model, the moving mechanism imitates an animal moving up and down during movement, a rider riding on the riding machine can experience the feeling of riding on a real animal With the walking mechanism and the steering mechanism, and the disposition of the external edge of the bottom plate with collision-proof tire, the rider can ride the riding machine to move backward and forward, and turn around as he pleases, and chase and crash other riders, for exercise and entertainment, and achieving relaxation and emotional exchange that give a new user experience.

DETAILED DESCRIPTION OF PREFERRED EMBODIMENTS

The present invention will be further described with the drawings and the embodiments.

Embodiments

Figure 1:
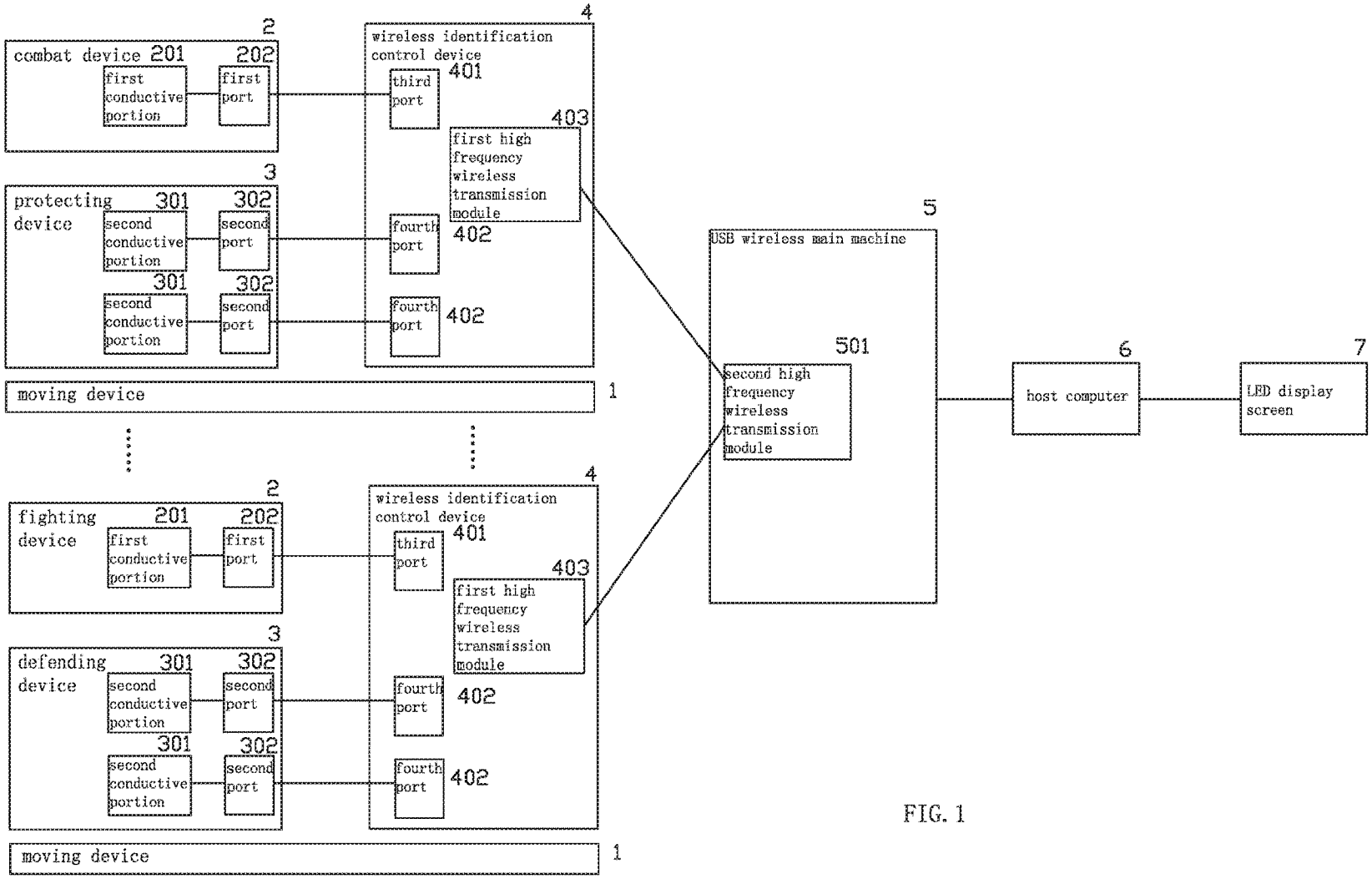
FIG. 1 illustrates a system block diagram of the present invention.

As shown in FIG. 1, the armed combat interactive system based on high frequency wireless scoring comprises:

a moving device 1 to carry a combat participant to move on a preset sports field;

a combat device 2 for the combat participant on the moving device to hold, the combat device 2 is disposed with a first conductive part 201 to realize electrical contact and a first port 202 to realize electric connect, the first conductive part 201 is connected to the first port 202;

a protecting device 3 to protect the given external portion of the combat participant on the moving device, the protecting device is disposed with two second conduction parts 301 to realize electrical contact and two second ports 302 to realize electric connect, the second conductive part 301 is correspondingly connected to the second port 302;

a wireless identification control device 4, the wireless identification control device 4 comprises a third port 401 and a fourth port 402 to realize an electric connect and a first high frequency wireless transmit module 403 to transmit wireless signal. The third port 401 of the wireless identification control device 4 is connected to the first port 202 of the combat device 2, so that the wireless identification control device 4 is connected to the first conductive part 201 of the combat device 2, the fourth port 402 of the wireless identification control device 4 is connected to the second port 302 of the protecting device, so that the wireless identification control device 4 is connected to the second conductive part 301 of the protecting device 3, and a scoring disposing device, the scoring disposing device comprises a second high frequency wireless transmission module 501. The first high frequency wireless transmission module 403 is connected to the second high frequency wireless transmission module 501 in wireless communication way;

when the first conductive part 201 of the combat device one combat participant holds touches the second conductive part 301 of the protecting device of another combat participant, the wireless identification control device 4 of one combat participant sends a high frequency pulse signal with ID identification code via the first conduction part 201.

The wireless identification control device 4 of the other combat participant receives the high frequency pulse signal with ID identification code of the wireless identification control device 4 of the combat participant via the second conductive part 301, after corresponding process, the wireless identification control device 4 of the other combat participant sends a scoring signal to the scoring disposing device via the first high frequency wireless transmission module, the scoring disposing device recodes the score.

The scoring disposing device comprises a USB wireless main machine 5 disposed around the sports field, a host computer 6 disposed around the sports field and a LED display screen 7 disposed around the sport field. The second high frequency wireless transmission module 501 is disposed in the USB wireless main machine 5, the USB wireless main machine 5 and the wireless identification control device 4 exchange data in wireless transmitting way via the first high frequency wireless transmission module 403 and the second high frequency wireless transmission module 501. The host computer and the USB wireless main machine exchange data in wire transmitting way. The input of the LED display screen 7 is connected to the output of the host computer 6.

Figure 2:
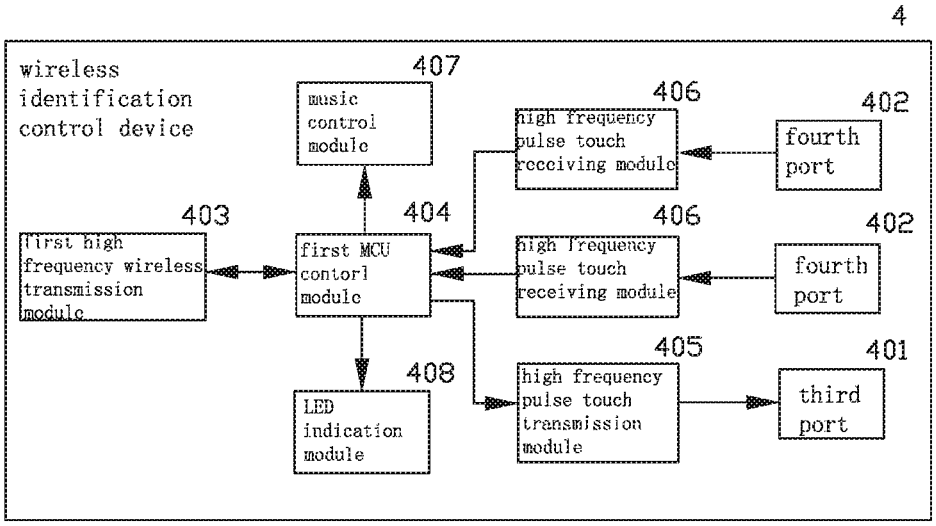
FIG. 2 illustrates a functional block diagram of the wireless identification control device of the present invention.

As shown in FIG. 2, the wireless identification control device 4 further comprises a first MCU control module 404, a high frequency pulse contact transmission module 405, an alarm module and at least two high frequency pulse contact receiving module 406. Therein the first high frequency wireless transmission module 403 is connected to the first MCU control module 404, the high frequency pulse signal output port of the first MCU control module 404 is connected to the input of the high frequency pulse contact transmission module 405, the high frequency pulse signal input port of the first MCU control module 404 is respectively connected to the outputs of the at least two high frequency pulse contact receiving module 406, the control signal output port of the first MCU control module 404 is connected to the alarm module, the output of the high frequency pulse contact transmission module 405 is connected to the third port 401, the inputs of the at least two high frequency pulse contact receiving module 406 are respectively connected to the corresponding fourth port 402.

In this embodiment, it is applied in fencing sports, the weapon is a sword, the fencer wears a helmet and an armor, the first conductive part 201 is disposed at the sword, there are two second conductive parts 301 disposed at the different positions of the fencer holding the weapon, one is disposed at the helmet, the other one is disposed at the armor, the armor can disposed with second conductive parts at different positions according to the chest, the back, the shoulder to score the stabled at the head and the body, so as to detailing the scores. Therefore, it needs corresponding high frequency pulse touch receiving module 406 and the fourth ports 402. In this embodiment, the wireless identification control device 4 comprises two high frequency pulse touch receiving modules 406, one is connected to the second conductive part 301 of the helmet to receive the information of the head, the other one is connected to the second conductive part 301 of the armor to receive the information of the body, the number of the high frequency pulse touch receiving modules is corresponding to the second conductive parts, when the second conductive parts are divided into two parts, it needs two high frequency pulse touch receiving modules, when the second conductive parts are divided into four parts (one at the head, three at the body: the chest, the back and the shoulder), it needs four high frequency pulse touch receiving modules. The fourth ports are disposed at the same way.

In this embodiment, the alarm module comprises a LED indication module 408 and a music control module 407, other alarm devices are available. The LED indication module 408 and the music control module 407 are respectively connected to the control signal output port of the first MCU control module 404.

Figure 3:
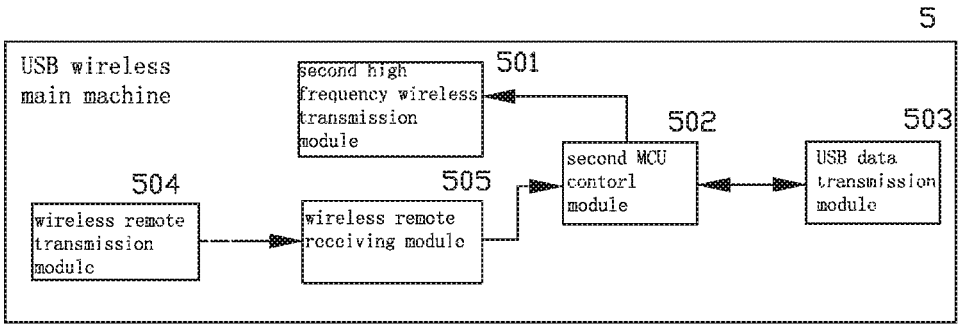
FIG. 3 illustrates a functional block diagram of the USB wireless main machine of the present invention.
Figure 4:
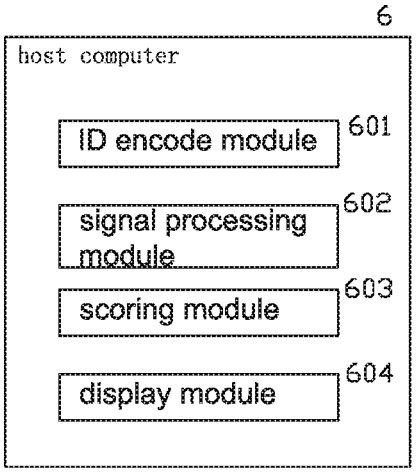
FIG. 4 illustrates a functional block diagram of the host computer of the present invention.

As shown in FIG. 3 and FIG. 4, the USB wireless main machine 5 further comprises a second MCU control module 502 and a USB data transmission module 503, therein, the second high frequency wireless transmission module 501 is connected to the second MCU control module 502, the second MCU control module 502 is connected to the USB data transmission module 503. The USB wireless main machine 5 and the wireless identification control device 4 exchange data in wireless transmitting way via the first high frequency wireless transmission module 403 and the second high frequency wireless transmission module 501. The host computer 6 is disposed with an ID encode module 601, a signal processing module 602, a scoring module 603 and a display module 604. The host computer 6 and the USB wireless main machine 5 exchange data in wire transmitting way via the USB data transmission module 503.

The USB wireless main machine 5 further comprises an external wireless remote transmission module 504 and a wireless remote receiving module 505, the output of the wireless remote receiving module 505 is connected to the second MCU control module 502.

The ID encode module 601 of the host computer 6 gives the wireless identification control devices 4 different ID identification codes. When the first conduction part 201 of a first wireless identification control device 4 touches the second conduction part 301 of a second wireless identification control device 4, the first MCU control module 404 of the first wireless identification control device sends a high frequency pulse signal with ID identification code of the wireless identification control device via the high frequency pulse touch transmission module 405 of the first wireless identification control device. The high frequency pulse touch receiving module 406 of the second wireless identification control device 4 receives the high frequency pulse signal with the corresponding ID identification code and transforms the high frequency pulse signal of the corresponding ID identification code to a corresponding ID identification code to the first MCU control module 404 of the second wireless identification control device. The first MCU control module 404 of the second wireless identification control device pack the corresponding ID identification code, the ID identification code of the second wireless identification control code and a feature code identifying the position of the second conductive part 301 of the second wireless identification control device to a data packet to send to the USB wireless main machine 5 by the transmission protocol between the second wireless identification control device and the USB wireless main machine 5. The USB wireless main machine 5 sends the data packet to the host computer 6 via the USB data transmission module, the signal processing module 602 of the host computer 6 identifies and processes the information of the data packet. When the corresponding ID identification code is the same as the preset ID identification code, it is judged invalid signal. When the corresponding ID identification code is different from the present ID identification code, the signal processing module 602 of the host computer 6 outputs control signal to the second wireless identification control device via the USB wireless main machine, the first MCU control module 404 of the second wireless identification control device outputs signal to the alarm module of the second wireless identification control device after receiving the control signal, the alarm module alarms, at the same time, the signal processing module 602 of the host computer outputs signal to the scoring module 603 of the host computer, the scoring module 603 records the score according to the preset mode and outputs the scores to the display module 604 of the host computer, the display module 604 of the host computer drives the LED display screen to display.

The armed combat interactive system based on high frequency wireless scoring records the score by high frequency pulse signal, the high frequency pulse touch transmission module 405 of the wireless identification control device 4 is used to read and store the ID identification code of the first MCU control module 404 and transform the ID identification code to high frequency pulse electric signal, when the first conductive part 201 of the combat device 2 touches the second conductive part 301 of the protecting device 3, the high frequency pulse electric signal is sent out. The high frequency pulse touch receiving module 406 of the wireless identification control device 4 is used that, when the second conductive part 301 of the protecting device 3 touches the first conductive part 201 of the combat device 2, it receives the high frequency pulse electric signal sent by the high frequency pulse touch transmission module 405 of the first conductive part 201 of the combat device and restores the high frequency pulse electric signal to corresponding ID identification code and sends to the first MCU control module 404. The music control module 407 of the wireless identification control device 4 is used to receive the control command of the first MCU control module 404 and drives the voice IC to play the sound, the voice is output by DAC and then amplified by special audio power amplifier to drive the speaker to make a sound. The LED indication module 408 of the wireless identification control device is used to receive the control command of the first MCU control module 404 and drive the LED to work, it is configured to two modes, one mode is that LED flashes 3 s after an effective strike, the other mode is that the LED lights slowly if the battery voltage drops down to the lowest working voltage to indicate low battery that it needs to recharge. The first MCU control module 404 of the wireless identification control device 4 is used to receive and process the ID identification code, control to send the high frequency pulse signal, control to play the music, control the LED to indicate and control the first frequency wireless transmission module 403 to receive and send data. The first high frequency wireless transmission module 403 of the wireless identification control device is used to send the data of the first MCU control module 404 to the USB wireless main machine 5 in wireless way and send the data sent from the USB wireless main machine 5 in wireless way to the first MCU control module 404, it has failure retransmission function and auto answer function, the transmission mode is half duplex two-way transmission, the transmission speed is 2 M/s, the second high frequency wireless transmission module 501 of the USB wireless main machine is used to decode and process the data from the first high frequency wireless transmission module 403 and transmit to the second MCU control module 502, it also used to analyze and process the data from the second MCU control module 502 and send the data to the wireless identification control device 4. The second MCU control module 502 of the USB wireless main machine is used to receive the data of the second high frequency wireless transmission module 501 and analyze and pre-process the data according to the communication protocols, and send the data to the host computer 6, and at the same time receive and analyze the data of the host computer 6 and then send the result to the second high frequency transmission module 501, and at the same time real time read the data of the wireless remote receiving module 505 and send the processed key information to the host computer.

Figure 5:
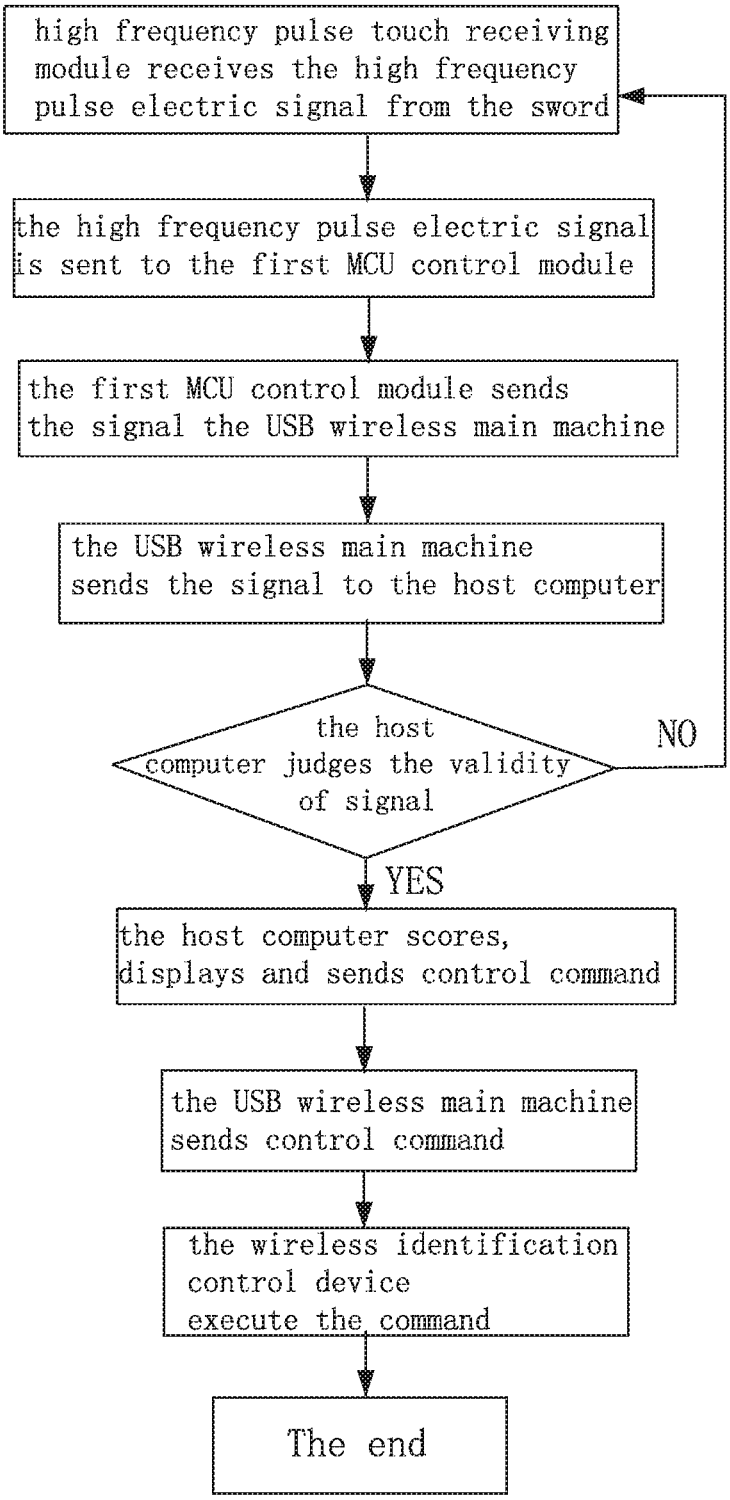
FIG. 5 illustrates a flow diagram of the scoring process of the present invention.
Figure 6:
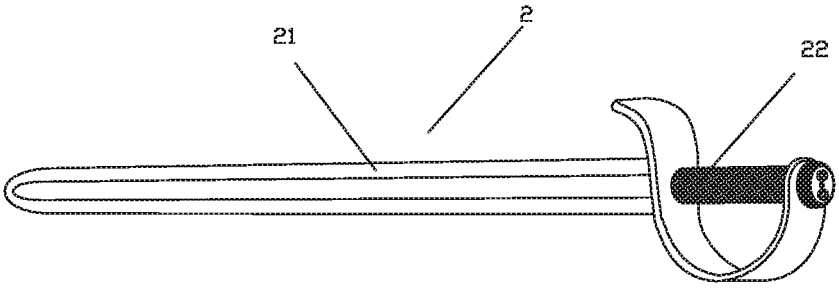
FIG. 6 illustrates a schematic diagram of the fighting device of the present invention.
Figure 7:
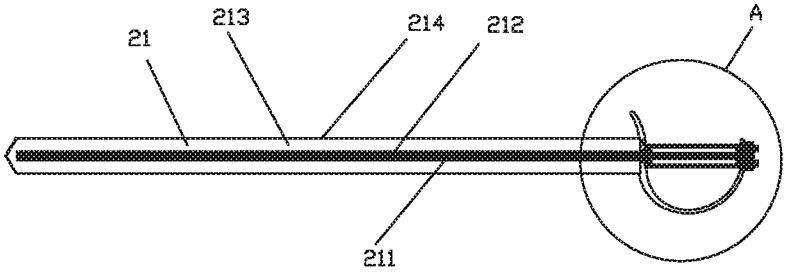
FIG. 7 illustrates a sectional diagram of the fighting device of the present invention.
Figure 8:
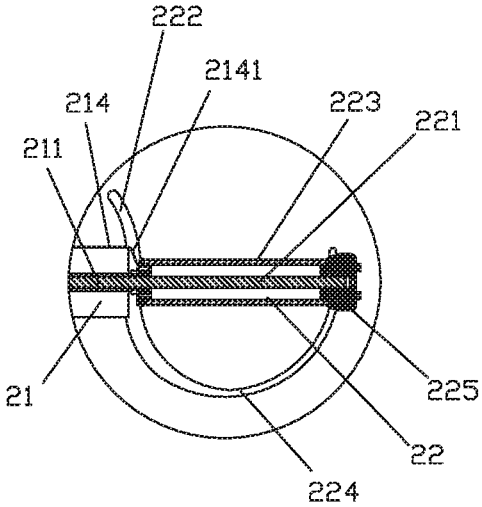
FIG. 8 illustrates an enlargement diagram of A part of FIG. 7.

As shown in FIG. 5, the scoring process of the armed combat interactive system comprises:

A. When the first conductive part 201 of the combat device 2 of a first wireless identification control device touches the second conductive part 301 of the protecting device 3 of a second wireless identification control device, the high frequency pulse touch receiving module 406 of the second wireless identification control device receives the high frequency pulse electric signal with ID identification code;

B. The high frequency pulse touch receiving module 406 sends the high frequency pulse electric signal with ID identification code to the first MCU control module 404 of the second wireless identification control device;

C. The first MCU control module 404 of the second wireless identification control device packs the ID identification code, the self ID identification code and a feature code identifying the position of the second conductive part to a data packet to send to the second high frequency wireless transmission module 501 of the USB wireless main machine 5 via the first high frequency wireless transmission module 403;

D. The second high frequency wireless transmission module 501 of the USB wireless main machine sends the data packet to the second MCU control module of the USB wireless main machine, the second MCU control module 502 sends the processed data to the host computer 6 via the USB data transmission module 503;

E. The host computer 6 judges the validity of the data, if the data is invalid, return to step A; if the data is valid, continue to the next step;

F. The host machine 6 accumulates the scores according to the preset scoring modes and the corresponding positions of the second conductive parts 301 and displays the results via the LED display screen 7, at the same time, the host computer 6 transmits control command to the second MCU control module 502 of the USB wireless main machine 5 via the USB data transmission module 503;

G. The second MCU control module 502 of the USB wireless main machine 5 sends the control command from the host machine 6 to the first high frequency wireless transmission module 403 of the second wireless identification control device 4 in wireless way via the second high frequency wireless transmission module 501;

H. The first high frequency wireless transmission module 403 of the second wireless identification control device transmits the control command to the first MCU control module 404, the first MCU control module 404 analyzes and processes to produce a corresponding control signal to output to the alarm module. The alarm module alarms with sound and light, then the end.

The armed combat interactive system based on high frequency wireless scoring of the present invention can achieve a two-player combat, A and B, they are riding on corresponding moving devices 1, A and B are respectively holding a combat device 2, for example a sword, A and B are respectively wearing a protecting device 3, for example an armor, they are respectively configured with a wireless identification control device 4, when the first conductive part 201 of the combat device 2 of A touches any second conductive part 301, it sends a high frequency pulse signal with an ID identification code of A out, there can be two situations, one is that A stables B, like the head, the other one is that A stables himself, like the head, when A stables B, the high frequency pulse touch receiving module 406 of the wireless identification control device 4 of B receives a high frequency pulse signal with A's ID identification code, B's wireless identification control device 4 processes the signal and sends the signal to the host computer 6 via the USB wireless main machine 5, the signal processing module 602 of the host computer 6 compares A's ID identification code and a preset ID identification code, as it is B's wireless identification control device 4 sends the signal, the preset ID identification code is B's ID identification code, they are different, so that the system scores; if it's A stabled himself, the high frequency pulse touch receiving module 406 of A's wireless identification control device 4 also receives the high frequency pulse signal with A's ID identification code, A's wireless identification control device 4 processes the signal and sends the signal to the host computer via the USB wireless main machine 5, the signal processing module 602 of the host computer 6 compares A's ID identification code and the preset ID identification code, as it's A's wireless identification control device 4 transmission the signal, the preset ID identification code is A's ID identification code, they are one code, it is judged to an invalid signal, the system doesn't score.

The armed combat interactive system based on high frequency wireless scoring of the present invention can achieve multi-player, A, B, C, D four players fight, the transmission process of scoring the signal is the same as above mentioned two-player mode, the judge mode of the host computer 6 is the same, it is judged to a valid signal if other players stable, it is an invalid signal if it's a self stable, in the scoring, it needs to score to the stabling players respectively.

The armed combat interactive system based on high frequency wireless scoring of the present invention can achieve group-player, the players are divided to two groups, the first group comprises A, B, C, the second group comprises D, E, F, the invalid signal not only comprises a self stabling, but also a group stabling, only if it's a opponent group stabling, it is valid, the preset ID identification code comprises the self ID identification code and the group ID identification code. The method is similar if there is multi-group and multi-player.

As shown in FIGS. 6-9, the armed combat interactive system based on high frequency wireless scoring of the present invention is provided that, the combat device 2 is a sword, the combat device 2 comprises a sword body 21 and a sword handle 22. The sword body 21 comprises a main backbone 211, an puncture-proof layer 212, a cushion layer 213 and a surface layer 214; in this embodiment, the surface layer 214 is made of conductive cloth, other conductive material or composite conductive material are available, only if they can catch the signals, the surface layer 214 forms the first conductive part. The puncture-proof layer 212 coats the main backbone 211, the buffer layer 213 coats the puncture-proof layer 212, the surface layer 214 coats the buffer layer 213. The sword body 21 is connected to the sword handle 22, the surface layer 214 is connected to the sword handle 22 by the wire 2141. In other case, the puncture-proof layer can not be required.

The sword handle 22 comprises a backbone core 221, a sword fixing element 222, a handle 223, a sword hand guard 224 and a weight balance body 225, the sword fixing element 222 is connected between the main backbone 211 of the sword and the backbone core 221 of the sword handle, one end of the handle element 223 is connected to the sword fixing element 222, the other end of the handle element is connected to the weight balance body 225. The hand guard 224 is arc shaped connected between the sword fixing element 222 and the weight balance body 225.

The backbone core 221 of the sword handle and the main backbone of the sword body are integrally connected, that is to say, the backbone core 221 passes through the sword fixing element 222 to connect to the main backbone of the sword body, the backbone core 221 of the sword handle and the main backbone 211 of the sword body are the same structure. The handle 223 is conductive material body, the surface layer 214 is connected to the handle 223 by the wire 2141, the handle 223 forms the first port.

The main backbone 211 is an elastic structure made of elastic steel, so that it can be bended, in other case, the main backbone can be an elastic structure made of other metal elastic material or non-metal elastic material, or the compositing, for example, it can be an elastic structure body made of glass fibre or elastic plastic.

The puncture-proof 212 is a shell made of puncture-proof cloth or composite material.

The buffer layer 213 is an elastic body made of composite material or rubber, or expanded plastic.

The cross section of the main backbone 211 is circle.

Figure 9:
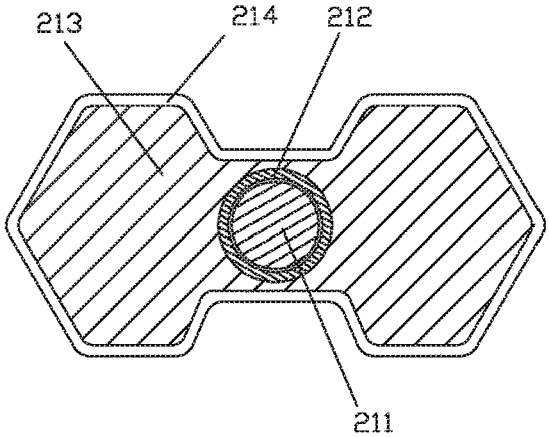
FIG. 9 illustrates a sectional diagram of the sword body of the fighting device of the present invention.

The cross section of the sword body 21 is barbell shaped, as shown in FIG. 9.

The external surface of the sword body of the present invention is disposed with a conductive cloth, so that the whole sword body is conductive, it is convenient to catch the signal so as to effectively score, it improves the entertainment of the fencing. The sword body comprises a main backbone 211, a puncture-proof layer 212, a buffer layer 213 and a conductive cloth 214, it makes the sword body 21 with light weight, and it can efficiently fence, it is convenient for the game, also it lengthens the service life of the sword, the main backbone 211 of the combat device is made of elastic steel or glass fibre, it is rigid and elastic. The anti-puncturing layer is made of anti-puncturing cloth, it can reduce the weight and the size, it also is convenient to assemble. The buffer layer 213 is made of sponge or rubber, it is light in weight, it can also protect the main backbone, when touching the opponent, it can work with cushion function that it would not hurt the opponent.

Figure 10:
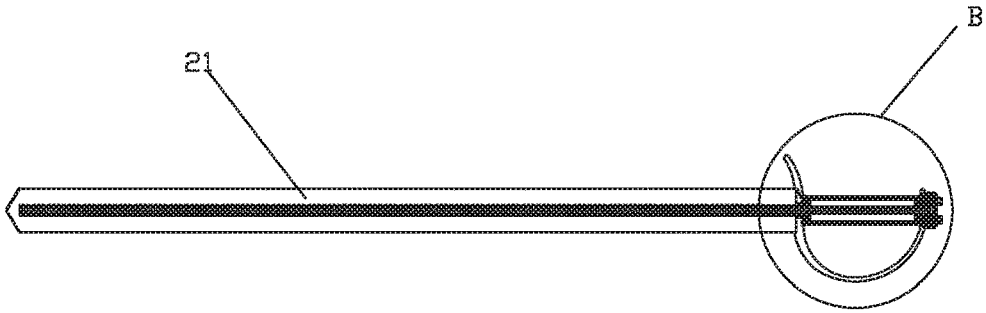
FIG. 10 illustrates a sectional diagram of another fighting device of the present invention.
Figure 11:
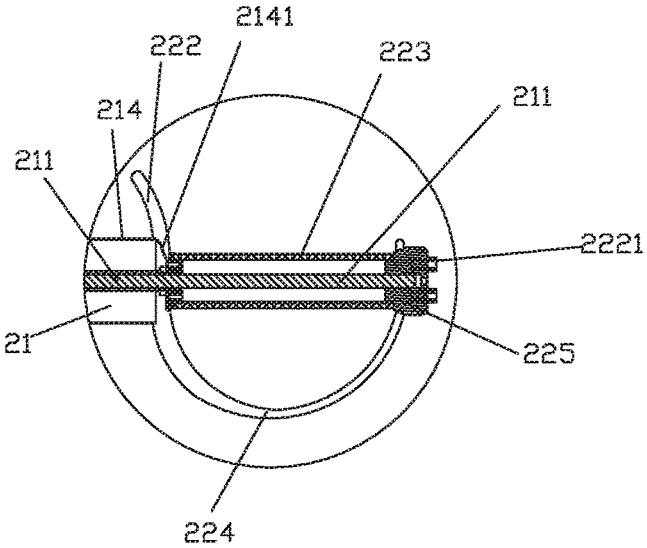
FIG. 11 illustrates an enlargement diagram of B part of FIG. 10.
Figure 12:
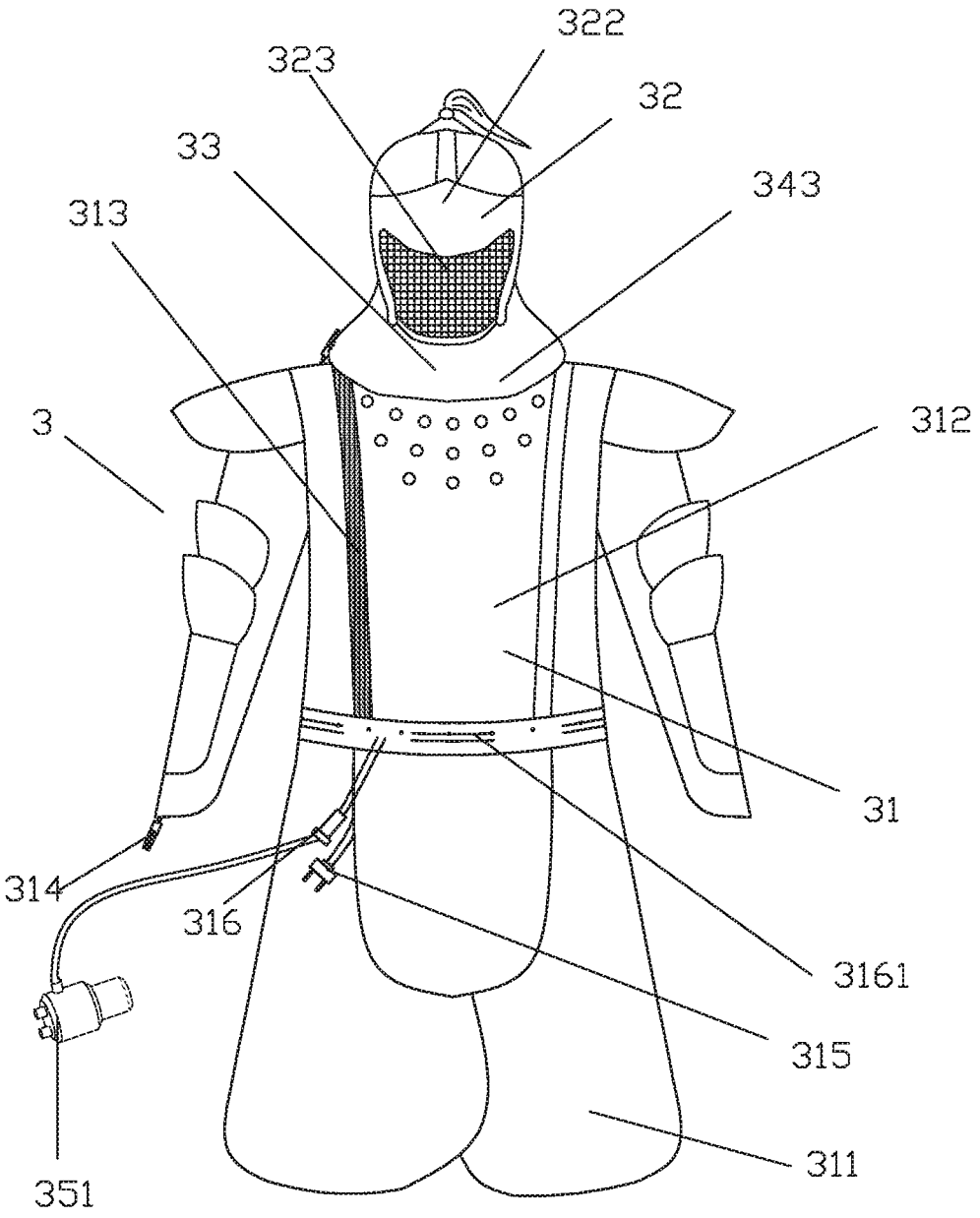
FIG. 12 illustrates a schematic diagram of the defending device of the present invention.
Figure 13:
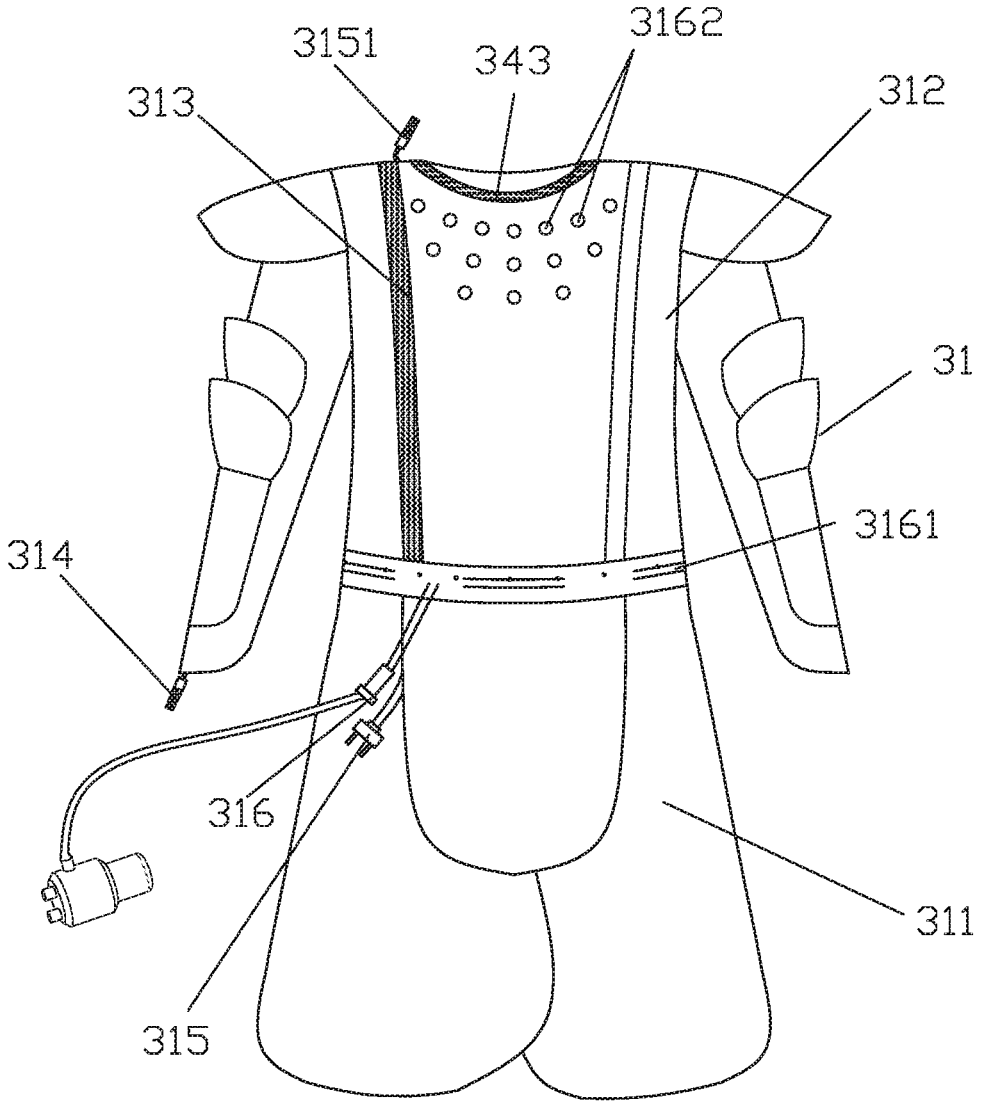
FIG. 13 illustrates a schematic diagram of the armor of the defending device of the present invention.
Figure 14:
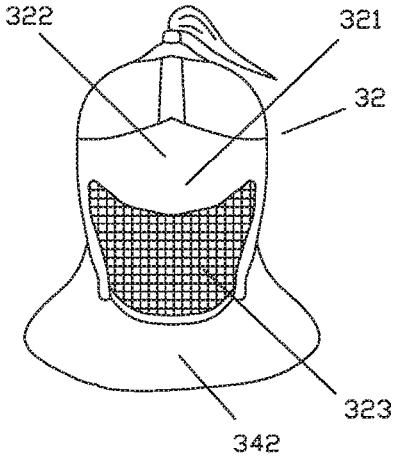
FIG. 14 illustrates a schematic diagram of the helmet of the defending device of the present invention.
Figure 15:
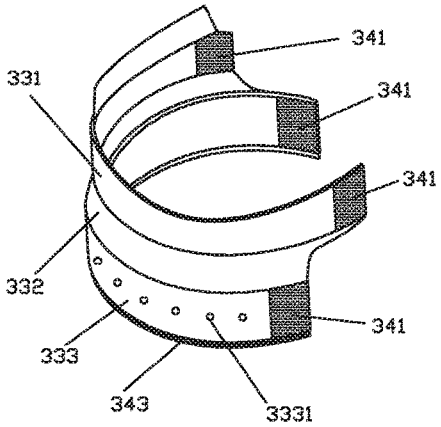
FIG. 15 illustrates a schematic diagram of the neck collar of the defending device of the present invention.
Figure 16:
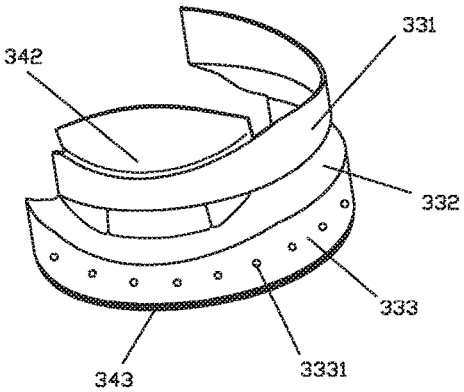
FIG. 16 illustrates a schematic diagram of the neck collar of the defending device of the present invention from another view angle.
Figure 17:
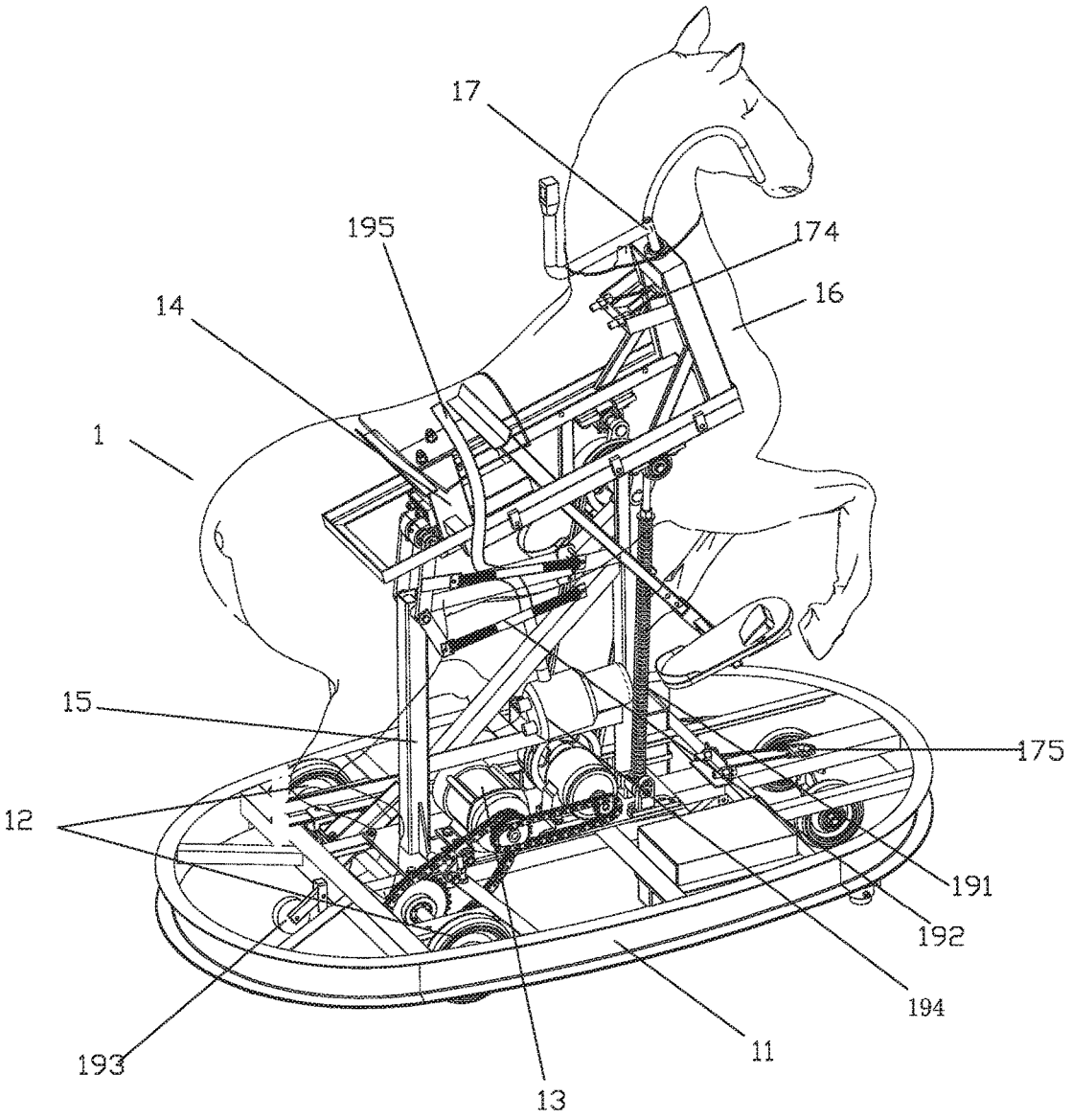
FIG. 17 illustrates a schematic diagram of the moving device of the present invention.
Figure 18:
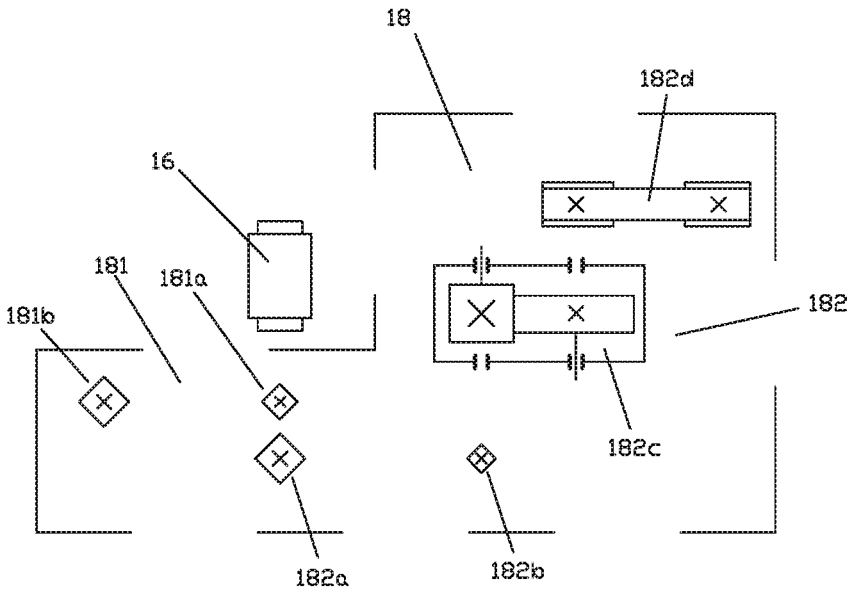
FIG. 18 illustrates a schematic diagram of the driving relationship of the moving device of the present invention.
Figure 19:
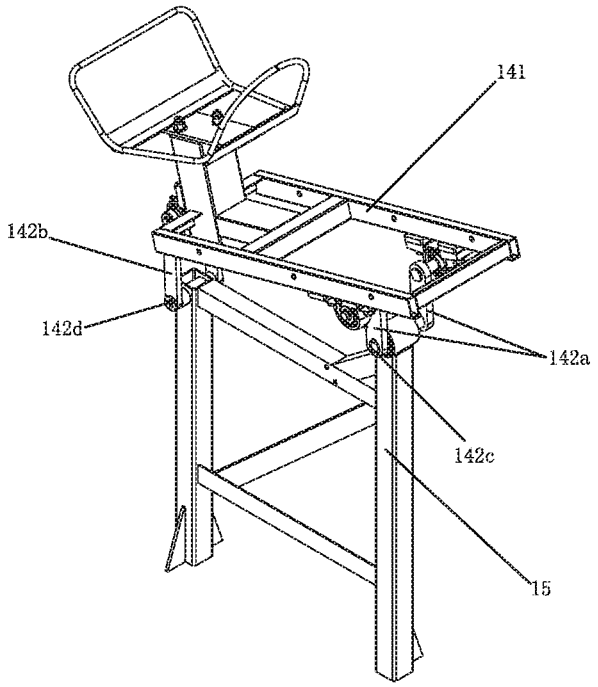
FIG. 19 illustrates a schematic diagram of the moving mechanism of the moving device of the present invention.
Figure 20:
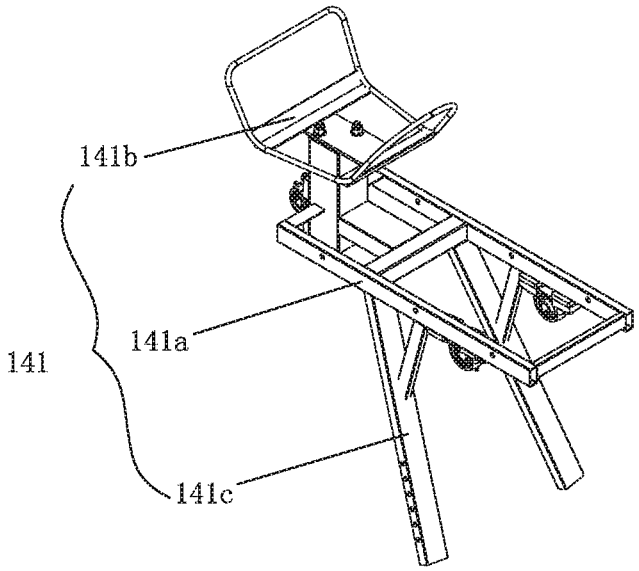
FIG. 20 illustrates a schematic diagram of the swinging cross arm of the moving device of the present invention.
Figure 21:
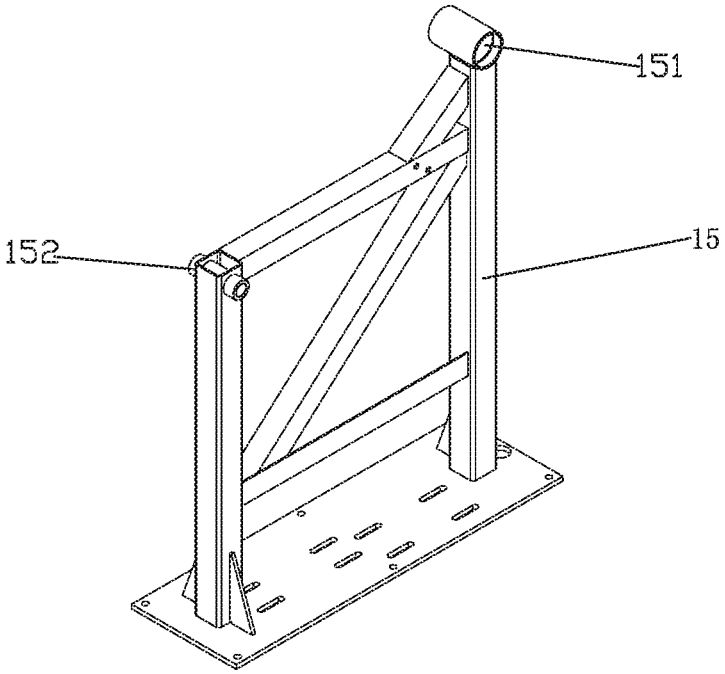
FIG. 21 illustrates a schematic diagram of the stand of the moving device of the present invention.
Figure 22:
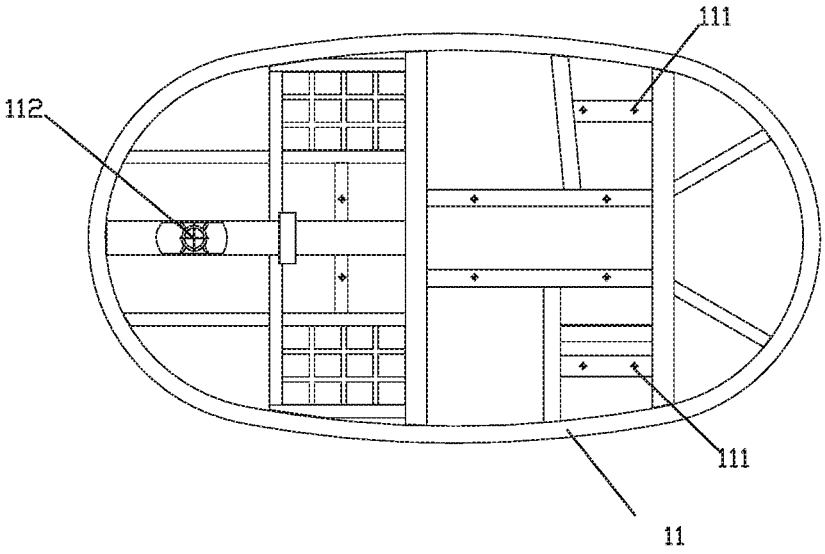
FIG. 22 illustrates a schematic diagram of the bottom plate of the moving device of the present invention.
Figure 23:
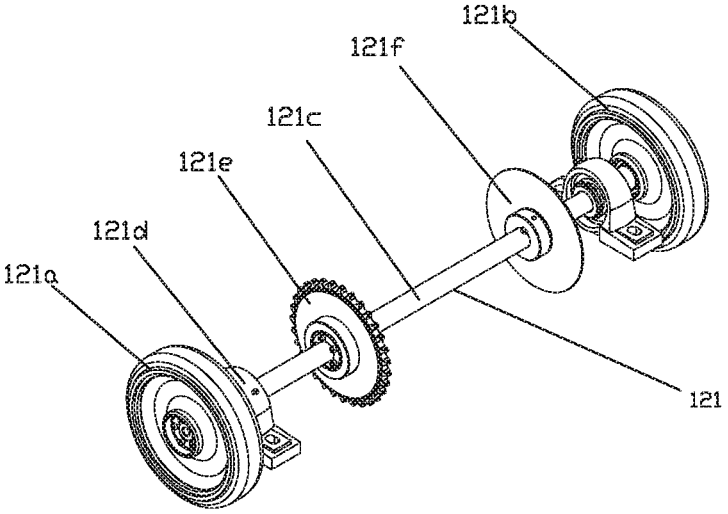
FIG. 23 illustrates a schematic diagram of the rear wheel of the moving device of the present invention.
Figure 24:
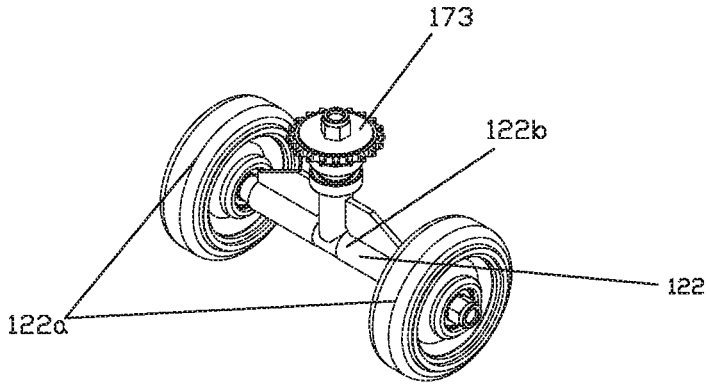
FIG. 24 illustrates a schematic diagram of the front wheel of the moving device of the present invention.
Figure 25:
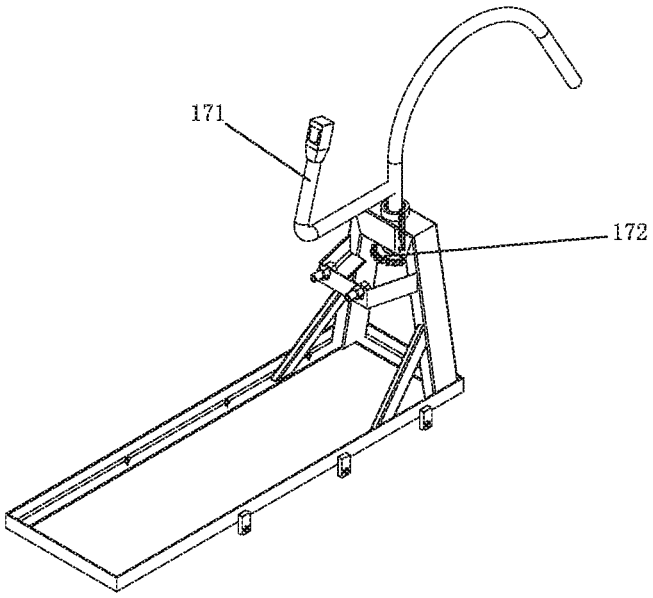
FIG. 25 illustrates a schematic diagram of the steering mechanism of the moving device of the present invention.

As shown in FIG. 10 and FIG. 11, the armed combat interactive system based on high frequency wireless scoring is provided that the combat device 2 can be another structure, the handle 223 can be an insulation body, the sword fixing element 222 is disposed with a first signal transmission port 2221, the conductive cloth 214 is connected to the first signal transmission port 2221 by the wire 2141. The first signal transmission port forms the first port.

As shown in FIGS. 12-16, the armed combat interactive system based on high frequency wireless scoring is provided that, the protecting device 3 comprises an armor 31. The armor 31 comprises a protecting cloth inner layer 311 and a conductive material outer layer 312, the conductive material outer layer 312 covers the center upper portion of the conductive material outer layer forms the second conductive part. The armor 31 is disposed with a first slot at the position corresponding to the front portion of the human being wearing the armor, the first slot is disposed with a first zipper 313 (the front zipper) to close the first slot when the first zipper 313 is zipped. The first zipper 313 is unzipped for the user to wear the armor, the armor is further disposed with a signal joint 314 at the position of the end of the arm of the human being for the electric signal of the handle combat weapon, the protecting armor of this embodiment is the protecting device for fending sports, the signal joint 314 is used for the electric signal of the handle composite conductive sword. The armor 31 is further disposed with a signal transmission joint 315, which is disposed with at least two signal transmission wires, one wire is connected to the electric signal joint of the combat weapon, the conductive word, the other wire is the second port to connect to the conductive cloth 3121 of the armor.

The armor 31 is disposed with an air inlet joint 316 at the position corresponding to the portion of the human being below the wrest, an air pipe 3161 at the inner side surrounding the wrest corresponding to the inner side of the wrest of the human being, the air pipe 3161 is connected to the air inlet joint 316, the air pipe 3161 is disposed with a plurality of air spraying holes directed upwardly. The armor 31 is further disposed with a plurality of first air holes 3162 at the position corresponding to the front chest of the human being.

The protecting device 3 further comprises a helmet 32. The helmet 32 comprises a shell shaped base body 321 made of glass steel and a conductive layer 322 coated on the surface of the base body. The signal transmission joint 315 of the helmet 1 is further disposed with a third signal transmission wire, which is connected to the conductive layer 322 of the helmet. The upper portion of the armor 31 is disposed with a helmet joint 3151, the third signal transmission wire is connected to the conductive layer 322 of the helmet joint 3151.

The helmet can be made of metal material, the third signal transmission wire forms the second port connected to the metal material of the helmet.

The protecting device 3 further comprises an air blowing device 351, which is connected to the air inlet joint 316.

The helmet 32 is disposed with a metal protecting screen 323 corresponding the face of the human being.

The protecting device 3 further comprises a neck collar 33 connected between the helmet 32 and the armor 31, the neck collar 33 comprises three parts: an upper part 331, a center part and a lower part 333. The upper and lower parts are made of material composed of tabby cloth material and hard elastic material body, therein, the tabby cloth is disposed at the surface layer. The center part 332 is applied with elastic cloth. The elastic cloth 332 is connected between the upper tabby cloth and the lower tabby cloth.

The lower portion 333 of the neck collar is disposed with a plurality of second air holes 3331 surrounding the neck of the human being.

The neck collar 33 is disposed with a disconnecting portion along the vertical direction to vertically disconnect neck collar. The disconnecting portion is disposed with a first nylon fastener 341, the neck collar 33 forms a shape surrounding a neck of a human being by the first nylon fastener 341, the first nylon fastener can be changed by a button.

The neck collar 33 is connected and fixed to the helmet 2 by the second nylon fastener 342, the second nylon fastener 342 can be changed by a button.

The neck collar 33 is connected to the armor 31 by the second zipper 343.

The surface of the armor 31 is made of conductive cloth 312, so that it can transmit signals.

The armor 31 is disposed with an air inlet joint 316 at the position corresponding to the portion of the human being below the wrest, an air pipe 3161 at the inner side surrounding the wrest corresponding to the inner side of the wrest of the human being, the air pipe 3161 is connected to the air inlet joint 316, the air pipe 3161 is disposed with a plurality of air spraying holes directed upwardly. The armor 31 is further disposed with a plurality of first air holes 3162 at the position corresponding to the front chest of the human being. The present invention is provided with the air inlet joint 316 connected to an air blowing device to blow hot air or cool air along the wrest and the air flows out of the first air holes 3162, so that it can achieve ventilation at the inner side, it works with the sweat layer the human being wearing (wearing under the armor) for heat proofing and deodorization.

The present invention is provided with a protecting armor that can transmission signals and regulate temperature, the armor is disposed with a first zipper 313 at the front position corresponding to a human being, it is convenient to wear; a second zipper 343 is disposed between the neck collar and the armor to make the neck collar detachable for washing and cleaning. The surface of the upper and lower portion of the neck collar is made of cloth, the inner layer is applied with an elastic material with a certain hardness (for bending), the center portion is made of elastic cloth, so that the player feels comfort when nodding or turning around the head. The outer side is connected by nylon fastener 341, the player can adjust the size of the neck collar according to self condition. The second air holes 3331 of the neck collar have breath and heat proofing functions. The neck collar 33 is connected to the armor 31 by the second zipper 343 and is connected to the helmet 32 by nylon fastener 342, it works with protecting the neck and the throat function.

The present invention is provided with a protecting armor that can transmission signals and regulate temperature, the helmet is applied with a safety helmet, it is made of a glass steel base body, and embedded with a head cloth, a jaw belt and other safety accessories, it is coated with conducting paint or electroplated, a metal protecting screen 323 is further assembled to transmit signal and protect the head. The nylon fastener 342 is used to connect to the neck collar 33.

As shown in FIGS. 17-25, the armed combat interactive system based on high frequency wireless scoring of the present invention is provided that, the moving device 1 is a motor driven horse riding machine, the motor driven horse riding machine 1 comprises a bottom plate 11, a walking mechanism 12, a driving mechanism 13, a moving mechanism 14, a stand 15, a steering mechanism 17 and an animal model 16. The waling mechanism 12 is assembled to the bottom plate 11 to drive the bottom plate 11 to walk. The driving mechanism 13 is assembled to the bottom plate 11 and is coupled to the walking mechanism 12. The stand 15 is assembled to the bottom plate 11, the moving mechanism 14 is assembled to the stand 14 and is coupled to the driving mechanism 13, the moving mechanism 14 imitates an animal under the supporting of the stand 15 and the driving of the driving mechanism 13. The animal model Ibis assembled to the moving mechanism 14 to form a movable animal. The steering mechanism 7 is assembled to the front portion of the animal model 16 and is coupled to the walking mechanism 12 to control the steering of the walking mechanism 12.

The riding machine further comprises a transmission mechanism 18, the transmission mechanism 18 is assembled to the bottom plate 11, the driving mechanism 13 is respectively coupled to the walking mechanism 12 and the moving mechanism 14 via the transmission mechanism 18.

The transmission 18 comprises a first transmission 181 with single speed and a second transmission 182 with multi-speed, the driving mechanism 13 is coupled to the walking mechanism 12 via the first transmission 181 with single speed, the first transmission 181 comprises a first driving wheel 181 and a first driven wheel 181*b*, the output of the driving mechanism 13 is connected to the first driving wheel 181*a*, the first driving wheel 181*a* transmits the power to the first driven wheel 181*b* via the chain, the first driven wheel 181*b* is connected to the rear wheel of the bottom plate 11 to drive the riding machine to move forwardly or backwardly. The second transmission mechanism 182 comprises a second driving wheel 182*a*, a second driven wheel 182*b*, a reducer 182*c* and a transmission belt wheel 182*d*. The output of the driving mechanism 13 is connected to the second driving wheel 182*a*, the second driving wheel 182*a* transmits power to the second driven wheel 182*b* via the chain, and is connected to the input of the reducer 182*c*, the output of the reducer 182*c* outputs via the transmission belt wheel 182*d*, and is connected to the driving shaft of the moving mechanism 14 to drive the driving shaft to rotate.

The moving mechanism 14 comprises a swinging cross arm 141 and a simulating motion mechanism 142. The simulating motion mechanism 142 comprises two cranks 142*a*, two driven rotating arms 142*b*, a driving shaft 142*c* and a driven shaft 142*d*. The front portion of the stand 15 is disposed with a driving bearing base 151, the driving shaft 142*c* is assembled to the driving bearing base, the rear portion of the stand 15 is disposed with a driven bearing base 152, the driven shaft 142*d* is assembled to the driven bearing base 152.

The driving shaft 142*c* is coupled to the driving mechanism 13; each end of the two cranks 142*a* are respectively connected to the two ends of the driving shaft 142*c*; each other end of the two cranks 142*a* are respectively connected to the front portion of the swinging cross arm 141; two driven rotating arms 142*b* are respectively connected between the two ends of the driven shaft 142*d* and the rear portion of the swinging cross arm 141. The crank 142*a* rotates under the driving of the driving shaft 142*c* to drive the front portion of the swinging cross arm 141 to rotate about the driving shaft 142*c*, the driven rotating arm 142*b* swings forwardly and backwardly under the driving of the swinging cross arm 141.

The swinging cross arm 141 comprises a cross arm body 141*a*, a saddle shaped support 141*b* and a step mounting rack 141*c*. The front portion of the cross arm body 141*a* is disposed with a driving shaft 142*c* to connect to the crank 142*a*, the rear portion of the cross arm body 141*a* is disposed with a driven shaft 142*d* to connect to the driven rotating arm 142*b*. The saddle shaped support 141*b* is fixed to the rear portion of the cross arm body 141*a*. The step mounting rack 141*c* is fixed to the bottom portions of the cross arm body 141*a*. The step mounting rack 141*c* is disposed at two sides of the cross arm body in dividing way and is connected respectively with a left step and a right step. The left step is disposed with a brake device, the brake device is a disc brake assembled to the rear wheel rotating shaft 121*c*, the brake step is assembled to the left step. When the brake step is pressed, the brake 121*f* works to brake. The right step is assembled with a accelerator, which is connected to the controller, the controller changes the output power of the driving mechanism 13 to realize speed regulating.

The animal model 16 comprises a fixing rack and an animal model shell. The fixing rack comprises a body fixing rack and a head fixing rack, the body fixing rack is fixed to the upper portion of the cross arm body 141*a*, the head fixing rack is fixed to the upper portion of the front side of the body fixing rack. The steering mechanism 17 is assembled to the head fixing rack.

The steering mechanism 17 comprises a steering handle 171, a steering upper chain wheel 172, a steering lower chain wheel 173, an upper chain 174, a lower chain 175 and a steel wire, the steering handle 171 is assembled to the head fixing rack, the steering upper chain wheel 172 is assembled to the steering handle 171, the steering lower chain wheel 173 is assembled to the walking mechanism 12, the upper chain and the lower chain are respectively assembled to the steering upper chain wheel and the steering lower chain wheel, the center of the two chains are connected by the steel wire. The steering handle 717 is assembled with a gear device with two gears, a forward gear and a backward gear. The gear device is connected to a controller, the controller is used to control the turn and reverse of the motor to achieve forward and backward moving state of the machine.

The walking mechanism 12 comprises a front wheel mechanism 122 and a rear wheel mechanism 121, the front wheel mechanism 122 comprises two front wheels 122*a* and a front wheel rotating shaft 122*b*, two front wheels 122*a* are respectively assembled to two ends of the front wheel rotating shaft 122*b*, the lower chain wheel 173 is assembled to the upper end of the front wheel rotating shaft. The front wheel mechanism 122 is rotatably assembled to the front shell fixing support 112 of the bottom plate 11.

The rear wheel mechanism 121 comprises a driving rear wheel 121*a*, a driven rear wheel 121*b*, a rear wheel rotating shaft 121*c*, a support bearing base 121*d*, a chain plate 121*e* and a brake 121*f*. The driving rear wheel 121*a*, the driven rear wheel 121*b*, the support bearing base 121*d*, the chain plate 121*e* and the brake 121*f* are respectively assembled to the rear wheel rotating shaft 121*c*. The driving rear wheel 121*a* is assembled to the rear wheel rotating shaft 121*c* by a expanding sleeve, the driving rear wheel 121*a* and the rear wheel rotating shaft 121*c* rotate synchronously. The driven rear wheel 121*b* is assembled to the rear wheel rotating shaft 121*c* by an antifriction bearing. The rear wheel mechanism 121 is assembled to the bottom plate 11 by the support bearing base 121*d* connecting to the bottom plate 11. The driving rear wheel 121 and the driven rear wheel 121*b* are respectively assembled to the rear wheel fixing base 111 of the bottom plate 11.

The moving device 1 further comprises an energy storing mechanism, the energy storing mechanism comprises a first spring mechanism 191 and a second spring mechanism 192, the first spring mechanism 191 is assembled between the swinging cross arm 141 and the bottom plate 11. The second spring mechanism 192 is assembled between the stand 15 and the driven rotating arm 152*b*. The first spring mechanism 191 and the second spring mechanism 192 use the springs to store energy and release energy, when the moving mechanism 14 swings downwardly, it stores energy, when the moving mechanism 14 swings upwardly, it releases energy, it can achieve energy saving effect.

The moving mechanism further comprises a ground conductive wheel 193, the ground conductive wheel 193 is assembled to the bottom portion of the bottom plate 11. The conductive wheel 193 is assembled to the bottom portion of the bottom plate by a bearing base, when the machine moves the conductive wheel rolls with the rear wheel on the conductive ground to form a stable and uninterruptable connection to realize a common reference ground point with other riding machines.

The moving device 1 further comprises a temperature regulating device, the temperature regulating device comprise an air pump 194 and an air pipe 195, the air pump is assembled to the stand, the air pipe is extending from the air pipe and fixing to the saddle shaped support. The air pump regulates the temperature produce air flow, and sprays the air flow from the air pipe to the rider to regulate the temperature.

The external edge of the bottom plate 11 is disposed with anti-collision device, which is made of tire and inner tube with special shape. When collision happens, the tire absorbs the energy to achieve buffer effect.

The armed combat interactive system based on high frequency wireless scoring of the present invention is applied with a motor-driven riding entertainment and fitness machine to be the moving device, the power source of the moving device is a DC motor, it can use a battery set and controller to supply power to the motor and control the motor. The motor output power transmits to the rear wheel mechanism via the transmission mechanism and the imitating moving mechanism. The animal model is assembled with a main switch, the riding machine is switched on to work. The rider rides on the saddle and holds the steering handle, the feet place on the steps. The right step is assembled with a accelerator. When the accelerator signal is transmitted to the controller, the controller controls the motor to rotate, the motor drives the rear wheel shaft to rotate by the reducing mechanism, the rear wheel shaft drives the driving rear wheel to rotate so as to drive the whole machine to move forward and backward. At the same time, the motor drives the imitating mechanism to move by the multi-speed transmission mechanism, the imitating mechanism drives the animal model and the swinging cross arm to move and also drives the saddle to imitate the movement path of the center of a horse. The accelerator can achieve starting up the whole machine to move and controlling the moving speed of the whole machine. The left step is assembled with a brake, when the brake signal is transmitted to the controller, the controller controls the motor to stop working, with the brake, the rear wheel shaft stops rotating, the driving rear wheel stops rotating, the whole machine is braked. The rider can control the steering handle, which is coupled to the steering device, to control the riding machine to move in any direction. The driving rear wheel and the driven rear wheel do not rotate synchronously when turning over, it avoids wheelslip. The steering handle is assembled with a gear device with two gears, a forward gear and a backward gear. When in the forward gear, the riding machine moves forwardly. When in backward gear, the riding machine moves backwardly. The external edge of the bottom plate is disposed with collision-proof tire, the tire absorbs the energy of collision to achieve buffer effect, so as to protect the rider. During the riding, the temperature regulating device provides air flow with different temperature to the rider so as to adjust the circumjacent temperature of the rider to achieve comfort. When riding, the rider controls the machine to move forwardly, backwardly and turning round as his pleases, and he can also chase and crash other riders, it can obtain fitness and entertainment, it also can achieve relax and emotional exchange that it gives a new using experiment for the users.

INDUSTRIAL APPLICABILITY

The present invention is provided with an armed combat interactive system based on high frequency wireless scoring, which comprises a moving device, a combat device, a protecting device, a wireless identification control device and a scoring device, the wireless identification control device comprises a first MCU control module, a high frequency pulse touch transmission module, an alarm module, a high frequency pulse touch receiving module and a first high frequency wireless transmission module, the scoring disposing device comprises a USB wireless host machine disposed around the sports field, a host computer disposed around the sports field and a LED display screen disposed around the sport field. The USB wireless host machine further comprises a second MCU control module, a USB data transmission module and a first high frequency wireless transmission module, the combat comprises a device body and a device handle.

The device body comprises a main backbone, a cushion layer and a surface layer from the inside to the outside. The surface layer is conductive, the protecting device comprises an armor, a helmet and a neck collar, the moving device comprises a bottom plate, a walking mechanism, a driving mechanism, a moving mechanism, a stand, a steering mechanism and an animal model, it is convenient for industrial manufacturing, the moving device, the combat device, the protecting device, the wireless identification control device and the scoring device are also convenient for industrial manufacturing.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. An armed combat interactive system based on high frequency wireless scoring, comprising:

a moving device capable to carry a combat participant to move on a preset sports field;

a combat device for the combat participant riding on the moving device to hold, the combat device having a first conductive portion for realizing an electrical contact and a first port for realizing an electric connection, the first conductive portion connected to the first port;

a protecting device to protect a given external portion of the combat participant riding on the moving device, the protecting device has at least one second conduction portion for realizing an electrical contact and a second port for realizing an electric connection, the second conductive portion connected to the second port;

a scoring processing device, the scoring processing device comprising a second high frequency wireless transmission module;

a wireless identification control device, the wireless identification control device configured on a body of the combat participant riding on the moving device, the wireless identification control device comprising a third port and a fourth port for realizing an electric connection and a first high frequency wireless transmission module for realizing a wireless signal transmission; the third port of the wireless identification control device connected to the first port of the combat device, so that the wireless identification control device is connected to the first conductive portion of the combat device, the fourth port of the wireless identification control device connected to the second port of the protecting device, so that the wireless identification control device is connected to the second conductive portion of the protecting device, the first high frequency wireless transmission module and the second high frequency wireless transmission module connected through wireless communication;

wherein when the first conductive portion of the combat device held by a first combat participant touches the second conductive portion of the protecting device of a second combat participant, the wireless identification control device of the first combat participant sends a high frequency pulse signal with an ID identification code via the first conduction portion; the wireless identification control device of the second combat participant receives the high frequency pulse signal with the ID identification code of the wireless identification control device of the first combat participant via the second conductive portion, the wireless identification control device of the second combat participant sends a scoring signal to the scoring processing device via the first high frequency wireless transmission module after corresponding processing, and the scoring processing device processes corresponding scoring;

wherein the scoring processing device comprises a USB wireless host provided in a periphery area of the sports field, a host computer provided in the periphery area of the sports field and an LED display screen provided in the periphery area of the sport field; the second high frequency wireless transmission module is provided in the USB wireless host; and the USB wireless host further comprises a second MCU control module and a USB data transmission module, the second high frequency wireless transmission module is connected to the second MCU control module, and the second MCU control module is connected to the USB data transmission module;

wireless transmission of data between the USB wireless host and the wireless identification control device is implemented through the first high frequency wireless transmission module and the second high frequency wireless transmission module; the host computer has an ID encode module, a signal processing module, a scoring module and a display module; wired transmission of data between the host computer and the USB wireless host is implemented through the USB data transmission module; an input of the LED display screen is connected to an output of the host computer; and wherein the armed combat interactive system is usable for two-player combat or combat between groups each having multiple players.

2. The armed combat interactive system based on high frequency wireless scoring according to claim 1, wherein the wireless identification control device further comprises a first MCU control module, a high frequency pulse contact transmission module, an alarm module and at least two high frequency pulse contact receiving modules; the first high frequency wireless transmission module is connected to the first MCU control module, a high frequency pulse signal output port of the first MCU control module is connected to an input of the high frequency pulse contact transmission module, the high frequency pulse signal input port of the first MCU control module is connected to the outputs of the at least two high frequency pulse contact receiving module respectively, a control signal output port of the first MCU control module is connected to the alarm module, an output of the high frequency pulse contact transmission module is connected to the third port, inputs of the at least two high frequency pulse contact receiving modules are connected to the respective fourth ports.

3. The armed combat interactive system based on high frequency wireless scoring according to claim 2, wherein the alarm module comprises an LED indication module and a music control module, the LED indication module and the music control module are connected to the control signal output port of the first MCU control module respectively.

4. The armed combat interactive system based on high frequency wireless scoring according to claim 1, wherein the USB wireless host further comprises an external wireless remote transmission module and a wireless remote receiving module, and an output of the wireless remote receiving module is connected to the second MCU control module.

5. The armed combat interactive system based on high frequency wireless scoring according to claim 1, wherein the ID encode module of the host computer assigns different ID identification codes respectively to a plurality of wireless identification control devices via the USB wireless host; when the first conduction portion of a first wireless identification control device touches the second conduction portion of a second wireless identification control device, the first MCU control module of the first wireless identification control device sends a high frequency pulse signal with the ID identification code of the wireless identification control device via the high frequency pulse touch transmission module of the first wireless identification control device; the high frequency pulse touch receiving module of the second wireless identification control device receives the high frequency pulse signal of the corresponding ID identification code and transforms the high frequency pulse signal of the corresponding ID identification code to the corresponding ID identification code, and the corresponding ID identification code is output to the first MCU control module of the second wireless identification control device; the first MCU control module of the second wireless identification control device packs the corresponding ID identification code, the ID identification code of the second wireless identification control device and a characterization code distinguishing the position of the second conductive portion connected to the second wireless identification control device into a data packet, and the data packet is sent to the USB wireless host using the transmission protocol between the second wireless identification control device and the USB wireless host; the USB wireless host sends the data packet to the host computer via the USB data transmission module, the signal processing module of the host computer identifies, determines and analyzes information in the data packet; when the corresponding ID identification code is identical to a preset ID identification code, it is judged as an invalid signal; when the corresponding ID identification code is different from the present ID identification code, the signal processing module of the host computer outputs control signal to the second wireless identification control device via the USB wireless host, the first MCU control module of the second wireless identification control device outputs a signal to the alarm module of the second wireless identification control device after receiving the control signal, and the alarm module alarms, the signal processing module of the host computer outputs signal concurrently to the scoring module of the host computer, the scoring module processes the score according to a preset mode and outputs a scoring result to a display module of the host computer, the display module of the host computer drives the LED display screen to display.

6. The armed combat interactive system based on high frequency wireless scoring according to claim 1, wherein the combat device comprises a device body and a device handle; the device body comprises, from an interior to an exterior, a main skeleton body, a cushion layer and a surface layer; the cushion layer coats the main skeleton body, the surface layer coats the cushion layer; the device body connects the device handle; the surface layer is composed of conductive material or composite conductive material; the surface layer forms the first conductive portion.

7. The armed combat interactive system based on high frequency wireless scoring according to claim 6, wherein the device body further comprises a stab-proof layer, the stab-proof layer coats the main skeleton body, the cushion layer coats the stab-proof layer; the main skeleton body is an elastic structure made of an elastic metal material, an elastic non-metal material or a combination thereof, the cushion layer is an elastic body made of composite material, rubber or foamed plastic; the stab-proof layer is a coat made of stab-proof cloth or composite material.

8. The armed combat interactive system based on high frequency wireless scoring according to claim 6, wherein the device handle comprises a skeleton core, a device body fixing component, a hand-grasp component, a device handle hand-guard component and a weight balance body, the device body fixing component is connected between the main skeleton of the device body and the skeleton core of the device handle, one end of the hand-grasp component is connected to the device body fixing component, the other end of the hand-grasp component is connected to the weight balance body; the device handle hand-guard component is arc-shaped and connected between the device body fixing component and the weight balance body.

9. The armed combat interactive system based on high frequency wireless scoring according to claim 8, wherein the surface layer is made of conductive cloth; the conductive cloth is connected to the device handle via a lead wire; the skeleton core of the device handle is integrally connected to the main skeleton body of the device body.

10. The armed combat interactive system based on high frequency wireless scoring according to claim 8, wherein the hand-grasp component is made of conductive material, the conductive cloth is connected to the hand-grasp component via a lead wire; the hand-grasp component forms the first port.

11. The armed combat interactive system based on high frequency wireless scoring according to claim 8, wherein the hand-grasp component is made of insulate material, the device body fixing component is provided with a first signal transmission port, the conductive cloth is connected to the first signal transmission port via a lead wire; the first signal transmission port forms the first port.

12. The armed combat interactive system based on high frequency wireless scoring according to claim 1, wherein the protecting device comprises an armor; the armor is formed of an inner protecting cloth layer and a outer conductive material layer, the outer conductive material layer covers the center portion and upper portion of the body wearing the armor, and the outer conductive material layer forms the second conductive part; a connecting device for the combat device electric signal is further provided at the position of the armor corresponding to the end position of the arm of the person wearing the armor for receiving the electric signal of the hand-grasp combat device; the armor is further provided with a signal transmission joint, the signal transmission joint is provided with at least two signal transmission wires, one wire is connected to the electric signal joint of the combat device, the other wire is the second port, and connected to the conductive material of the armor; the armor is further provided with an air inlet joint and an air duct, the air duct is connected to the air inlet joint, and the air duct is further provided with a first air spraying hole, a first ventilating hole throughout inside and outside is provided in the armor.

13. The armed combat interactive system based on high frequency wireless scoring according to claim 12, wherein the protecting device further comprises a helmet; the helmet is made of glass steel with a surface coated with a conductive layer or metal material, the conductive layer coated on the surface or the metal material to form the second conductive portion; a signal transmission joint is further provided with a third signal transmission wire, the third signal transmission wire forms the second port and is connected to the conductive layer or the metal material of the helmet.

14. The armed combat interactive system based on high frequency wireless scoring according to claim 13, wherein the helmet is provided with a metal protecting net at a position corresponding to the face of the person; the armor is provided with a first slot at a position corresponding to a front portion of a wearer, the first slot is provided with a first zipper closing the first gap when the first zipper is zipped.

15. The armed combat interactive system based on high frequency wireless scoring according to claim 14, wherein the protecting device further comprises a neck collar connected between the helmet and the armor, the neck collar comprises an upper part, a center part and a lower part; the upper part and the lower part are made of material composed of cloth material and hard elastic material body, and the cloth material is arranged at a surface layer; the center part is elastic cloth; the elastic cloth is connected between the upper cloth material layer and the lower cloth material layer; the lower part of the neck collar is further provided with a plurality of second ventilating holes surrounding a neck of the wearer.

16. The armed combat interactive system based on high frequency wireless scoring according to claim 15, wherein the neck collar is provided with a disconnecting portion along the vertical direction to vertically disconnect neck collar; the disconnecting portion is disposed with a first nylon fastener or a first button, the neck collar forms a shape surrounding a neck of the wearer by the first nylon fastener or the first button; the neck collar and the helmet are connected and fixed by a second nylon fastener or a second button; the neck collar and the armor are connected by a second zipper or a third button.

17. The armed combat interactive system based on high frequency wireless scoring according to claim 1, wherein the moving device comprises a bottom plate, a walking mechanism, a driving mechanism, a moving mechanism, a stand rack, a steering mechanism and an animal model; the waling mechanism is assembled to the bottom plate to drive the bottom plate to move; the driving mechanism is assembled to the bottom plate and is coupled to the walking mechanism; the stand rack is assembled to the bottom plate, and the moving mechanism is assembled to the stand rack and is coupled to the driving mechanism, the moving mechanism imitates an animal motion under the supporting of the stand rack and the driving of the driving mechanism; the animal model is assembled to a moving mechanism to simulate an animal movement; the steering mechanism is assembled to the front portion of the animal model and is coupled to the walking mechanism to control the steering of the walking mechanism.

18. The armed combat interactive system based on high frequency wireless scoring according to claim 17, wherein the moving device further comprises a transmission, the transmission is assembled to the bottom plate, the driving mechanism is coupled to the walking mechanism and the moving mechanism respectively via the transmission; the transmission comprises a first transmission with single speed change and a second transmission with multiple speed change, the driving mechanism is coupled to the walking mechanism via the first transmission with single speed change, the driving mechanism is coupled to the second moving mechanism via the second transmission with multiple speed change.

19. The armed combat interactive system based on high frequency wireless scoring according to claim 17, wherein the moving mechanism comprises a swinging crossing rack and a simulating motion mechanism; the simulating motion mechanism comprises two cranks, two driven rotating arms, a driving shaft and a driven shaft; the driving shaft and the driven shaft are respectively assembled to a front portion and a rear portion of the stand rack and are rotatable, and the driving shaft is coupled to the driving mechanism; each end of the two cranks are respectively connected to two ends of the driving shaft; each of the other ends of the two cranks are respectively connected to the front portion of the swinging crossing rack; two driven rotating arms are respectively connected between the two ends of the driven shaft and the rear portion of the swinging cross arm.

20. The armed combat interactive system based on high frequency wireless scoring according to claim 19, wherein the swinging crossing rack comprises a crossing rack body, a saddle shaped support and a step mounting rack; the front portion of the crossing rack body is provided with a crank bearing base to connect to the crank, the rear portion of the crossing rack body is provided with a driven bearing base to connect to the driven rotating arm; the saddle shaped support is fixed to the rear portion of the crossing rack body; the step mounting rack is fixed to the bottom portions at the two sides of the crossing rack body.

21. The armed combat interactive system based on high frequency wireless scoring according to claim 20, wherein the animal model comprises a fixing rack and an animal model shell; the fixing rack comprises a body fixing rack and a head fixing rack, the body fixing rack is fixed to the crossing rack body, the head fixing rack is fixed to the upper portion of a front side of the body fixing rack; the steering mechanism is assembled to the head fixing rack.

22. The armed combat interactive system based on high frequency wireless scoring according to claim 17, wherein the steering mechanism comprises a steering handle, a steering upper chain wheel, a steering lower chain wheel, an upper chain, a lower chain and a steel wire, the steering handle is assembled to the head fixing rack, the steering upper chain wheel is assembled on the steering handle, the steering lower chain wheel is assembled on the walking mechanism, the upper chain and the lower chain are assembled to the steering upper chain wheel and the steering lower chain wheel respectively, the two chains are connected by the steel wire.

23. The armed combat interactive system based on high frequency wireless scoring according to claim 22, wherein the walking mechanism comprises a front wheel mechanism and a rear wheel mechanism, the front wheel mechanism comprises two front wheels and a front wheel rotating shaft, two front wheels are assembled to two ends of the front wheel rotating shaft respectively, the lower chain wheel is assembled to the upper end of the front wheel rotating shaft.

24. The armed combat interactive system based on high frequency wireless scoring according to claim 17, wherein the rear wheel mechanism comprises a driving rear wheel, a driven rear wheel, a rear wheel rotating shaft, a support bearing base, a chain plate and a brake; the driving rear wheel, the driven rear wheel, the support bearing base, the chain plate and the brake are assembled to the rear wheel rotating shaft respectively; the driving rear wheel is assembled to the rear wheel rotating shaft by a power lock, the driving rear wheel and the rear wheel rotating shaft rotate synchronously; the driven rear wheel is assembled to the rear wheel rotating shaft by a rolling bearing; the rear wheel mechanism is assembled to the bottom plate by the support bearing base connecting to the bottom plate.

25. The armed combat interactive system based on high frequency wireless scoring according to claim 19, wherein the moving device further comprises an energy storing mechanism, the energy storing mechanism comprises a first spring mechanism and a second spring mechanism, the first spring mechanism is assembled between the swinging crossing rack and the bottom plate; the second spring mechanism is assembled between the stand rack and the driven rotating arm.

26. The armed combat interactive system based on high frequency wireless scoring according to claim 17, wherein the moving mechanism further comprises a common-ground conductive wheel, the common-ground conductive wheel is assembled to the bottom portion of the bottom plate.

27. The armed combat interactive system based on high frequency wireless scoring according to claim 19, wherein the moving device further comprises a temperature regulating device, the temperature regulating device comprises an air pump and an air duct, the air pump is assembled to the stand rack, the air duct extends from the air pump and is fixated to the swinging crossing rack.

28. The armed combat interactive system based on high frequency wireless scoring according to claim 4, wherein the ID encode module of the host computer assigns different ID identification codes respectively to a plurality of wireless identification control devices via the USB wireless host; when the first conduction portion of a first wireless identification control device touches the second conduction portion of a second wireless identification control device, the first MCU control module of the first wireless identification control device sends a high frequency pulse signal with the ID identification code of the wireless identification control device via the high frequency pulse touch transmission module of the first wireless identification control device; the high frequency pulse touch receiving module of the second wireless identification control device receives the high frequency pulse signal of the corresponding ID identification code and transforms the high frequency pulse signal of the corresponding ID identification code to the corresponding ID identification code, and the corresponding ID identification code is output to the first MCU control module of the second wireless identification control device; the first MCU control module of the second wireless identification control device packs the corresponding ID identification code, the ID identification code of the second wireless identification control device and a characterization code distinguishing the position of the second conductive portion connected to the second wireless identification control device into a data packet, and the data packet is sent to the USB wireless host using the transmission protocol between the second wireless identification control device and the USB wireless host; the USB wireless host sends the data packet to the host computer via the USB data transmission module, the signal processing module of the host computer identifies, determines and analyzes information in the data packet; when the corresponding ID identification code is identical to a preset ID identification code, it is judged as an invalid signal; when the corresponding ID identification code is different from the present ID identification code, the signal processing module of the host computer outputs control signal to the second wireless identification control device via the USB wireless host, the first MCU control module of the second wireless identification control device outputs a signal to the alarm module of the second wireless identification control device after receiving the control signal, and the alarm module alarms, the signal processing module of the host computer outputs signal concurrently to the scoring module of the host computer, the scoring module processes the score according to a preset mode and outputs a scoring result to a display module of the host computer, the display module of the host computer drives the LED display screen to display.

* * * * *